US012576314B2

(12) United States Patent
Ono et al.

(10) Patent No.: US 12,576,314 B2
(45) Date of Patent: Mar. 17, 2026

(54) GOLF CLUB HEAD

(71) Applicant: SUMITOMO RUBBER INDUSTRIES, LTD., Kobe (JP)

(72) Inventors: Takashi Ono, Kobe (JP); Naruhiro Mizutani, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 271 days.

(21) Appl. No.: 18/542,004

(22) Filed: Dec. 15, 2023

(65) Prior Publication Data

US 2024/0198192 A1 Jun. 20, 2024

(30) Foreign Application Priority Data

Dec. 16, 2022 (JP) ..... 2022-200847

(51) Int. Cl.
*A63B 53/04* (2015.01)

(52) U.S. Cl.
CPC ..... *A63B 53/0466* (2013.01); *A63B 53/0408* (2020.08); *A63B 53/0412* (2020.08); *A63B 53/0437* (2020.08)

(58) Field of Classification Search
CPC ..... A63B 53/0466; A63B 53/0437; A63B 53/0408
See application file for complete search history.

(56) References Cited

U.S. PATENT DOCUMENTS

2015/0087434 A1* 3/2015 Hayashi ..... A63B 53/04 473/291
2021/0268346 A1 9/2021 Nakamura et al.

* cited by examiner

*Primary Examiner* — Raeann Gorden
(74) *Attorney, Agent, or Firm* — Birch, Stewart, Kolasch & Birch, LLP

(57) ABSTRACT

A head has a curvature radius R of a boundary portion between a hitting face and a crown surface, and has a curvature radius S of a boundary portion between the hitting face and a sole surface. The head has, on its toe side, a curvature radius Rt, a curvature radius St, a face height Ft, and a head thickness Tt. The head has, at its center, a curvature radius Rc, a curvature radius Sc, a face height Fc, and a head thickness Tc. The head 4 has, on its heel side, a curvature radius Rh, a curvature radius Sh, a face height Fh, and a head thickness Th. Ft/Tt is smaller than Fh/Th. The head satisfies the following relationship (a) and/or (b):

$$Rt > Rc \geq Rh; \quad \text{(a)}$$

$$St > Sc \geq Sh. \quad \text{(b)}$$

12 Claims, 18 Drawing Sheets

Cross section taken along line E1

GOLF CLUB HEAD

CROSS REFERENCE TO RELATED APPLICATION

The present application claims priority to Japanese Patent Application No. 2022-200847 filed on Dec. 16, 2022. The entire contents of this Japanese Patent Application are hereby incorporated by reference.

BACKGROUND

Technical Field

The present disclosure relates to golf club heads.

Description of the Related Art

There has been known a golf club head including a crown. As shown in, for example, JP2021-132995A (US2021/0268346A1), such a head usually includes a rounded boundary portion between a crown surface and a hitting face, and a rounded boundary portion between a sole surface and the hitting face.

SUMMARY

The inventors of the present disclosure have found that a novel shape of such rounded boundaries can achieve new advantageous effects.

One of the objects of the present disclosure is to provide a golf club head that has an improved performance obtained by a novel shape of the boundary portion between a hitting face and a crown surface or a sole surface.

In one aspect, a golf club head according to the present disclosure includes a hitting face that includes a face center, a crown surface, and a sole surface. A boundary portion between the hitting face and the crown surface has a curvature radius denoted by R. A boundary portion between the hitting face and the sole surface has a curvature radius denoted by S. The hitting face has a face height denoted by F. The golf club head has a head thickness denoted by T. The curvature radius R at a position spaced 15 mm apart from the face center toward a toe side is referred to as a curvature radius Rt, the curvature radius S at the same position is referred to as a curvature radius St, the face height F at the same position is referred to as a face height Ft, and the head thickness T at the same position is referred to as a head thickness Tt. The curvature radius R at a position of the face center is referred to as a curvature radius Rc, the curvature radius S at the same position is referred to as a curvature radius Sc, the face height F at the same position is referred to as a face height Fc, and the head thickness T at the same position is referred to as a head thickness Tc. The curvature radius R at a position spaced 15 mm apart from the face center toward a heel side is referred to as a curvature radius Rh, the curvature radius S at the same position is referred to as a curvature radius Sh, the face height F at the same position is referred to as a face height Fh, and the head thickness T at the same position is referred to as a head thickness Th. Ft/Tt is smaller than Fh/Th. This golf club head satisfies the following relationship (a) and/or the following relationship (b). That is, the golf club head satisfies only (a), only (b), or (a) and (b):

$$Rt > Rc \geq Rh; \quad \text{(a)}$$

$$St > Sc \geq Sh. \quad \text{(b)}$$

BRIEF DESCRIPTION OF THE DRAWINGS

FIG. 3 shows the head which is in a reference state;

FIG. 4B shows only a cross-sectional contour line of the head outer surface;

FIG. 6 is a diagram for illustrating definitions of a curvature radius R, a curvature radius S, a face height F, and a head thickness T;

FIG. 8 shows the head which is in the reference state;

FIG. 11 shows the head which is in the reference state;

FIG. 14 shows the head which is in the reference state;

FIG. 16 shows the head which is in the reference state;

DESCRIPTION OF THE PREFERRED EMBODIMENTS

Hereinafter, the present disclosure will be described in detail based on preferred embodiments with appropriate references to the accompanying drawings.

In the present disclosure, a reference state, a reference perpendicular plane, a toe-heel direction, a face-back direction, an up-down direction, a face center, and a vertical cross section are defined as follows.

Figure 18:
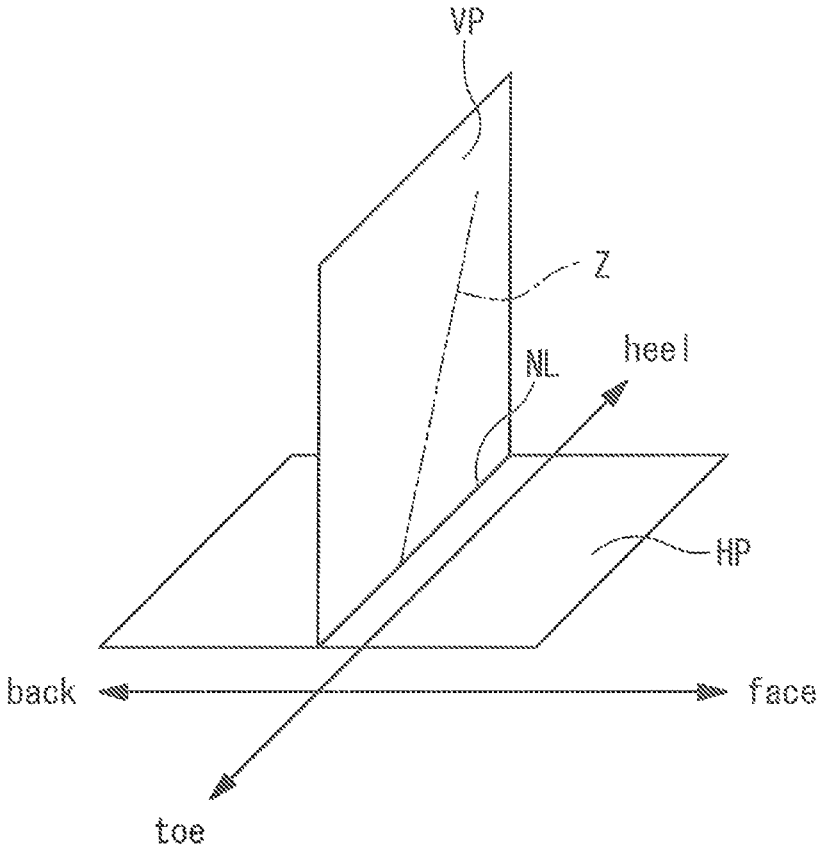
FIG. 18 is a conceptual diagram for illustrating the reference state.

The reference state is a state where a head is placed at a predetermined lie angle on a ground plane HP. As shown in FIG. 18, in the reference state, a shaft axis line Z lies on (is contained in) a plane VP that is perpendicular to the ground plane HP. The shaft axis line Z is the center line of a shaft. The shaft axis line Z usually coincides with the center line of a hosel hole. The plane VP is referred to as the reference perpendicular plane. The predetermined lie angle is shown in a product catalog, for example.

There has been known a club including a changing mechanism in which its loft angle, lie angle and face angle can be adjusted by changing a rotational position of a sleeve or the like provided at a tip portion of a shaft. In a head used for such clubs, the shaft axis line Z of the head which is in the reference state is specified in a state where all adjustable items are set to be neutral. The term "neutral" means the center of the range of adjustment.

In the reference state, a face angle is 0°. That is, in a planar view of a head as viewed from above, a line normal to its hitting face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 18).

In the present disclosure, the face-back direction is a direction that is perpendicular to the toe-heel direction and is parallel to the ground plane HP.

In the present disclosure, the up-down direction is a direction that is perpendicular to the toe-heel direction and is perpendicular to the face-back direction. In other words, the up-down direction in the present disclosure is a direction perpendicular to the ground plane HP.

In the present disclosure, the face center is determined in the following manner. First, a point Pr is selected roughly at the center of a hitting face in the up-down direction and the toe-heel direction. Next, a plane that passes through the point Pr, extends in the direction of a line normal to the hitting face at the point Pr, and is parallel to the toe-heel direction is determined. An intersection line between this plane and the hitting face is drawn, and a midpoint Px of this intersection line is determined. Next, a plane that passes through the midpoint Px, extends in the direction of a line normal to the hitting face at the midpoint Px, and is parallel to the up-down direction is determined. An intersection line between this plane and the hitting face is drawn, and a midpoint Py of this intersection line is determined. Next, a plane that passes through the midpoint Py, extends in the direction of a line normal to the hitting face at the midpoint Py, and is parallel to the toe-heel direction is determined. An intersection line between this plane and the hitting face is drawn, and a midpoint Px of this intersection line is newly determined. Next, a plane that passes through this newly-determined midpoint Px, extends in the direction of a line normal to the hitting face at this midpoint Px, and is parallel to the up-down direction is determined. An intersection line between this plane and the hitting face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center.

In the present disclosure, the vertical cross section is defined as each of cross sections taken along respective planes perpendicular to the toe-heel direction. The vertical cross section is parallel to the face-back direction. The vertical cross section is perpendicular to the ground plane HP. A cross-sectional contour line (contour line in a cross section) of a head outer surface in the vertical cross section is also referred to as a vertical cross-sectional contour line. The vertical cross section can be set at each position in the toe-heel direction.

Figure 1:
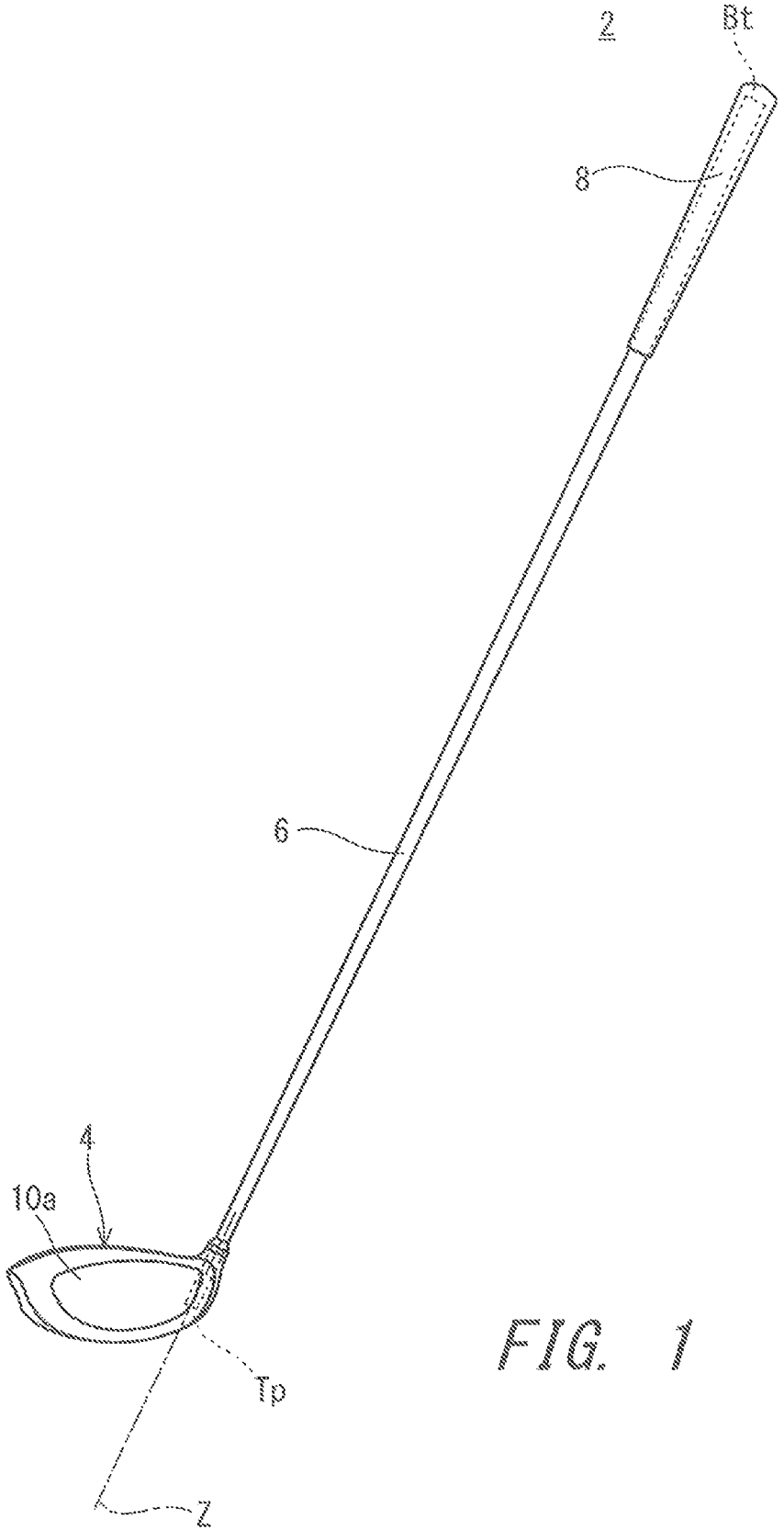
FIG. 1 shows a golf club in which a head according to a first embodiment is attached.

FIG. 1 is an overall view of a golf club 2 that includes a head 4 according to a first embodiment of the present disclosure. As shown in FIG. 1, the golf club 2 includes the golf club head 4, a shaft 6, and a grip 8. The shaft 6 has a tip end Tp and a butt end Bt. The head 4 is attached to a tip end portion of the shaft 6. The grip 8 is attached to a butt end portion of the shaft 6.

The golf club 2 is a driver (No. 1 wood). The head 4 is a driver head. Typically, a driver club has a length of greater than or equal to 43 inches. The golf club 2 is a wood-type golf club.

The shaft 6 is in a tubular form. The shaft 6 is hollow. The material of the shaft 6 is a carbon fiber reinforced resin. From the viewpoint of weight reduction, a carbon fiber reinforced resin is preferable as a material for the shaft 6. The shaft 6 is a so-called carbon shaft. Preferably, the shaft 6 is formed with a cured prepreg sheet. In the prepreg sheet, fibers are substantially oriented in one direction. Such a prepreg in which fibers are substantially oriented in one direction is also referred to as UD prepreg. The term "UD" stands for unidirectional. A prepreg other than the UD prepreg may be used. For example, fibers contained in the prepreg sheet may be woven. The shaft 6 may include a metal wire. The material of the shaft 6 is not limited, and may be a metal, for example.

The grip 8 is a part that a golfer grips during a swing. Examples of the material of the grip 8 include rubber compositions and resin compositions. The rubber composition for the grip 8 may contain air bubbles.

The head 4 is hollow. In the present embodiment, the head 4 is a wood type head. The head 4 may be a hybrid type head. Examples of a preferable material for the head 4 include metals and fiber reinforced plastics. Examples of the metals include titanium alloys, pure titanium, stainless steel, maraging steel, and soft iron. Examples of the fiber reinforced plastics include carbon fiber reinforced plastics. The head 4 may be a composite head including a portion made of a metal and a portion made of a fiber reinforced plastic.

Figure 2:
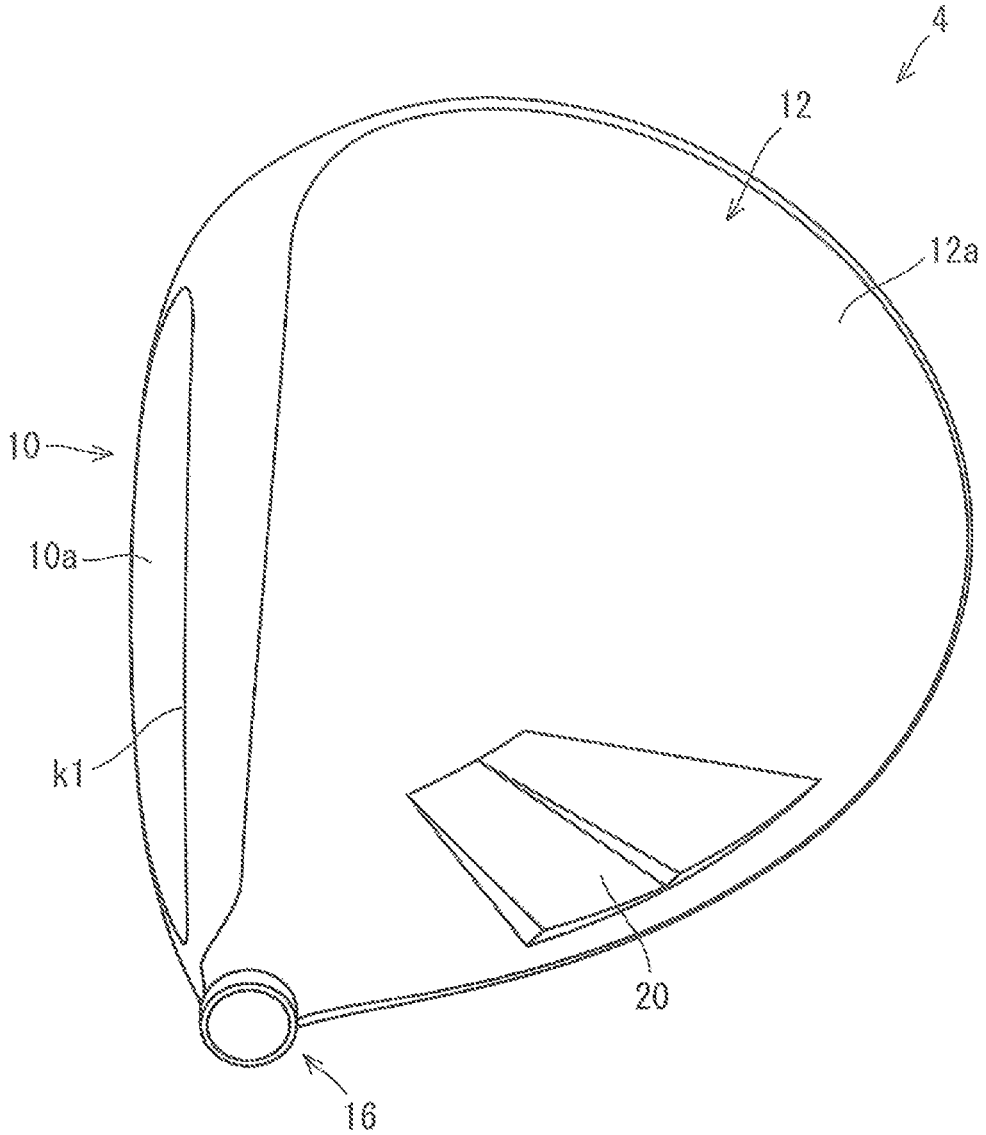
FIG. 2 is a plan view of the head of the first embodiment as viewed from a crown side.
Figure 3:
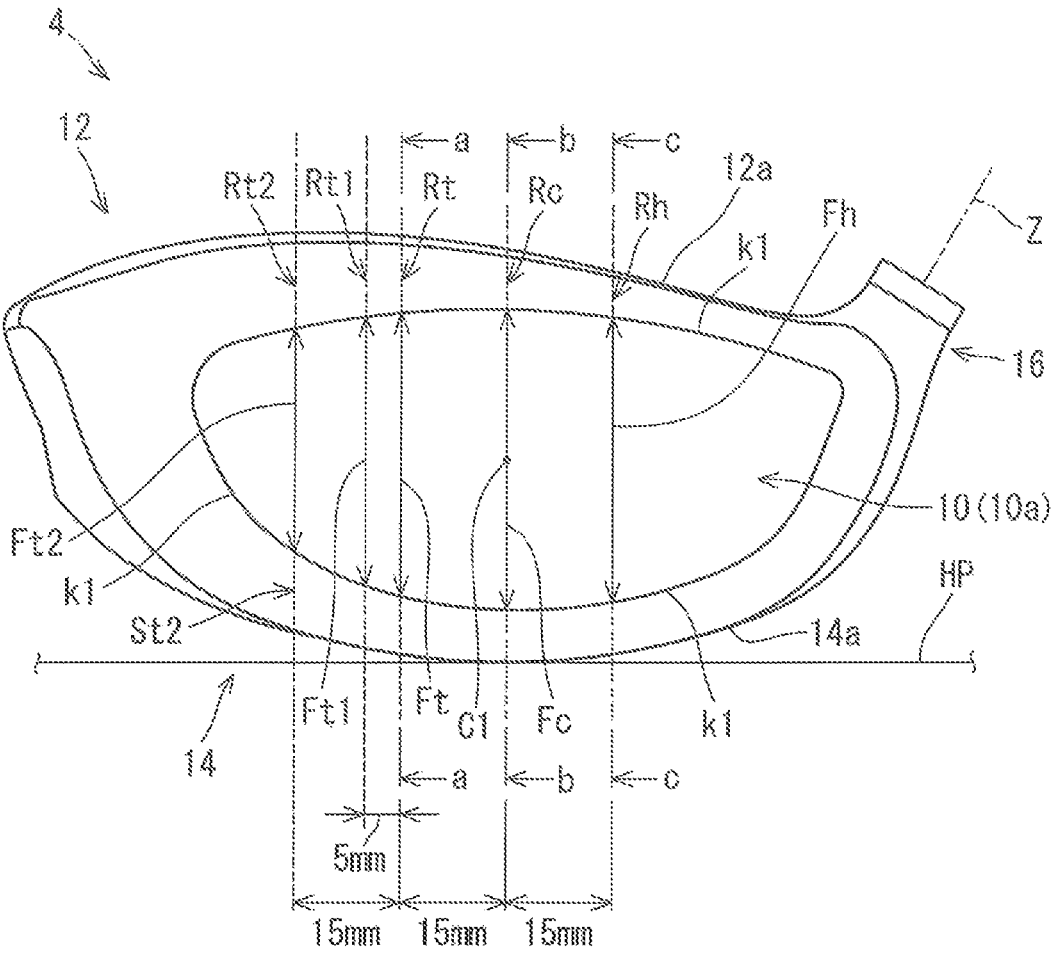
FIG. 3 is a front view of the head of the first embodiment as viewed from a face side.
Figure 4A:
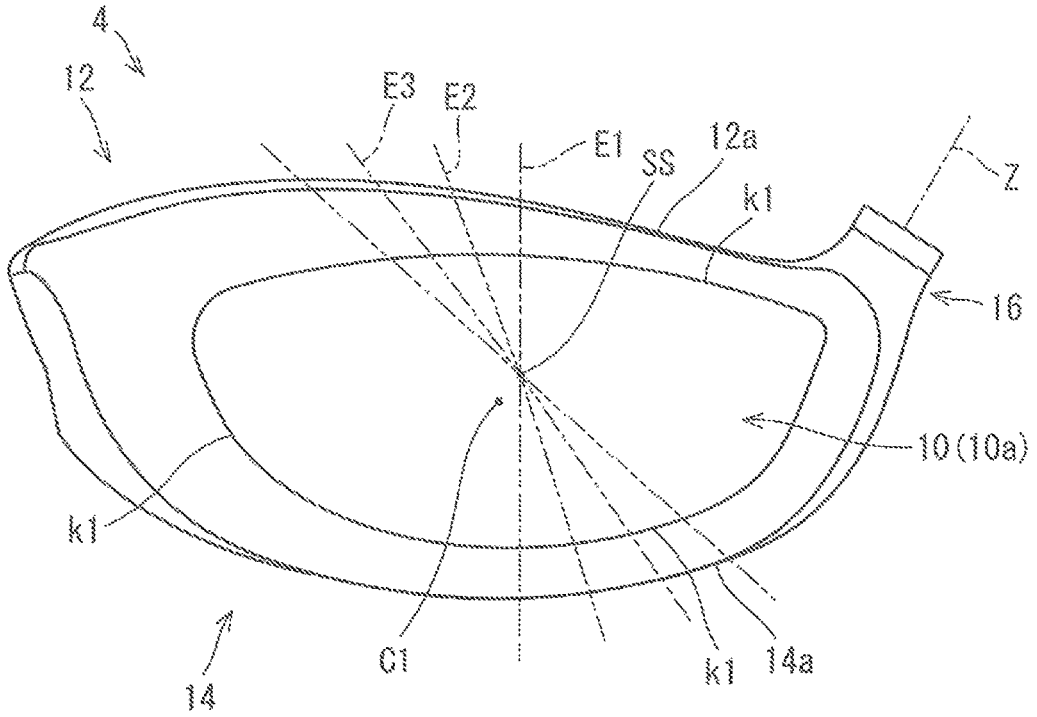
FIG. 4A is the same front view as FIG. 3.
Figure 4B:
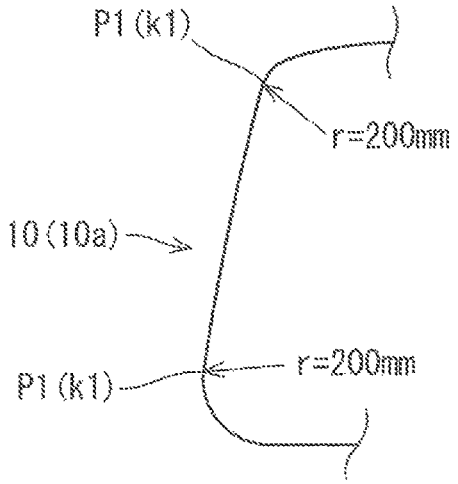
FIG. 4B is a cross-sectional view taken along line E1 in FIG. 4A.

FIG. 2 is a plan view of the head 4 as viewed from above. FIG. 3 is a front view of the head 4. FIG. 3 shows the head 4 which is in the reference state as viewed from the face side. FIG. 4A is the same front view as FIG. 3. FIG. 4B is a cross-sectional view taken along line E1 in FIG. 4A. FIG. 4B shows only the cross-sectional contour line of the head outer surface.

As shown in FIG. 2 and FIG. 3, the head 4 includes a face portion 10, a crown portion 12, a sole portion 14, and a hosel portion 16. The face portion 10 includes a hitting face 10*a*. The hitting face 10*a* is constituted by the outer surface of the face portion 10. The hitting face 10*a* is a curved surface that is convex toward the outside of the head 4. The hitting face 10*a* includes a face bulge and a face roll. The hitting face 10*a* is also simply referred to as a face or a face surface. The crown portion 12 forms a crown outer surface 12*a*. The crown outer surface 12*a* is also simply referred to as a crown surface. The sole portion 14 forms a sole outer surface 14*a*. The sole outer surface 14*a* is also simply referred to as a sole surface. The hitting face 10*a*, the crown surface 12*a* and the sole surface 14*a* constitute the head outer surface.

The hitting face 10*a* has a face center C1 as defined above.

The hitting face 10*a* has an outer edge k1. The outer edge k1 is a contour line of the hitting face 10*a*. The outer edge k1 is a boundary line between the hitting face 10*a* and other portions. The outer edge k1 of the hitting face 10*a* can be defined as follows. As shown in FIG. 4A and FIG. 4B, there are a large number of flat planes each of which contains a straight line that connects a center of gravity of the head 4 and a sweet spot SS, for example, flat planes E1, E2, and E3 in FIG. 4A. In each cross section taken along the flat planes such as the flat plane E1, when a curvature radius r of the cross-sectional contour line of the head outer surface is sequentially observed from the sweet spot SS toward the outside of the hitting face 10*a*, a point at which the curvature radius r becomes 200 mm for the first time is defined as a point P1. A set of the points P1 can be the outer edge k1 of the hitting face 10*a*. Note that the sweet spot SS means an intersection point between the hitting face 10*a* and a straight line that is perpendicular to the hitting face 10*a* and passes through the center of gravity of the head 4.

As shown in FIG. 2, the crown portion 12 includes a crown protrusion 20. The crown protrusion 20 forms a protrusion on the crown surface 12*a*. The crown protrusion 20 is not viewable in the front view (FIG. 3) of the head 4 as viewed from the face side. The entirety of the crown protrusion 20 is positioned on the heel side with respect to the face center C1.

Figure 5A:
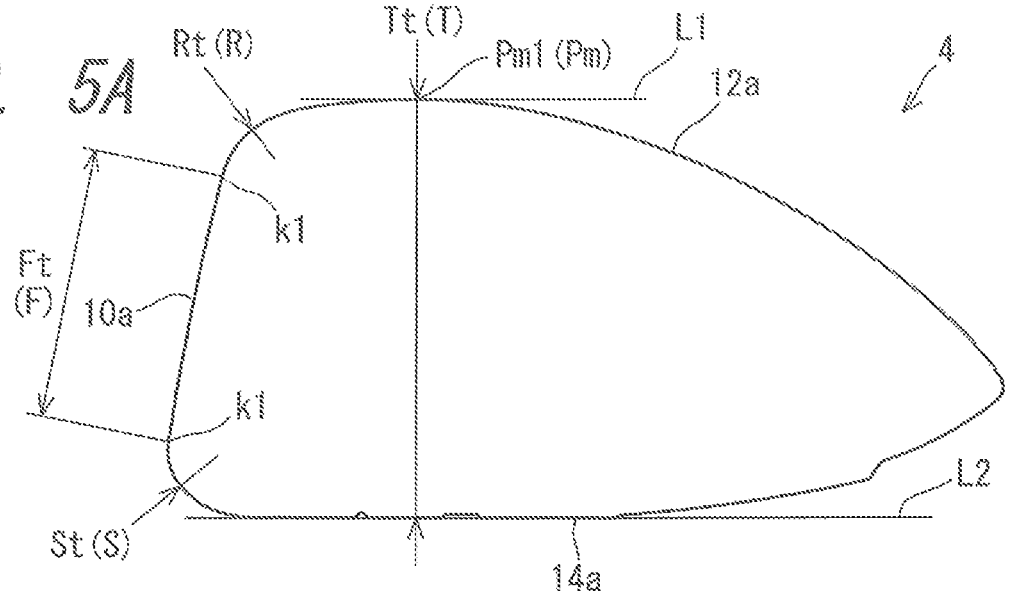
FIG. 5A shows a cross-sectional contour line of the head outer surface in a cross-sectional view taken along line a-a in FIG. 3.
Figure 5B:
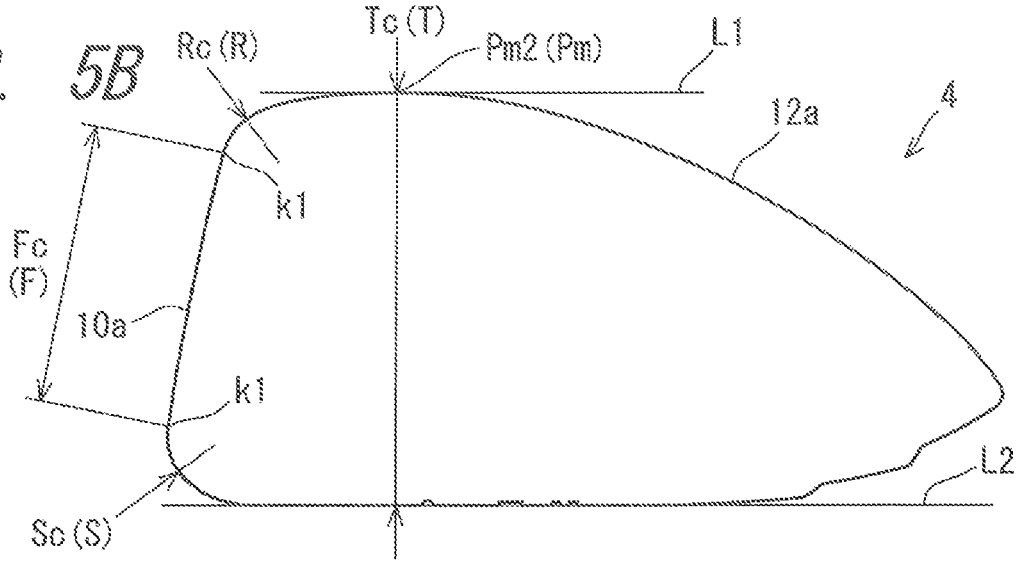
FIG. 5B shows a cross-sectional contour line of the head outer surface in a cross-sectional view taken along line b-b in FIG. 3.
Figure 5C:
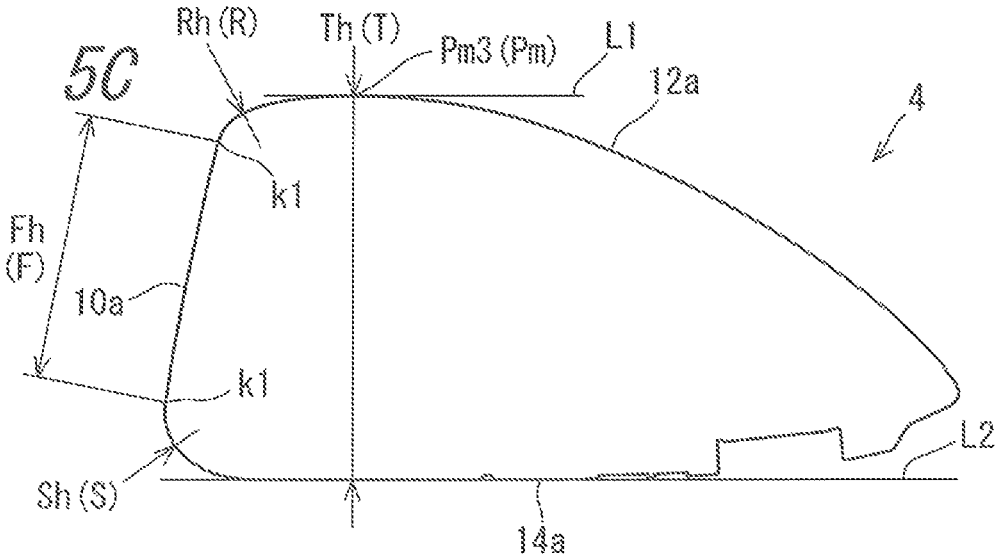
FIG. 5C shows a cross-sectional contour line of the head outer surface in a cross-sectional view taken along line c-c in FIG. 3.

FIG. 5A is a cross-sectional view taken along line a-a in FIG. 3. FIG. 5B is a cross-sectional view taken along line b-b in FIG. 3. FIG. 5C is a cross-sectional view taken along line c-c in FIG. 3. FIG. 5A, FIG. 5B and FIG. 5C each show a vertical cross-sectional contour line. FIG. 5A shows a vertical cross-sectional contour line at a position spaced 15 mm apart from the face center C1 toward the toe side. FIG. 5B shows a vertical cross-sectional contour line at a position of the face center C1. FIG. 5C shows a vertical cross-sectional contour line at a position spaced 15 mm apart from the face center C1 toward the heel side.

The head 4 has a curvature radius R at the boundary portion between the hitting face 10*a* and the crown surface 12*a*. The curvature radius R is measured on a vertical cross-sectional contour line. The curvature radius R is determined at each position in the toe-heel direction. As shown in FIG. 5A, the curvature radius R at the position spaced 15 mm apart from the face center C1 toward the toe side is represented by a curvature radius Rt. As shown in FIG. 5B, the curvature radius R at the position of the face center C1 is represented by a curvature radius Rc. As shown in FIG. 5C, the curvature radius R at the position spaced 15 mm apart from the face center C1 toward the heel side is represented by a curvature radius Rh. For the sake of easy understanding, in the present disclosure, the symbols "R", "Rt", "Rc", "Rh" and the like are used for showing the kind of curvature radius, and also used as reference symbols in drawings. The unit of these curvature radii is "mm".

The head 4 has a curvature radius S at the boundary portion between the hitting face 10*a* and the sole surface 14*a*. The curvature radius S is measured on a vertical cross-sectional contour line. The curvature radius S is measured at each position in the toe-heel direction. As shown in FIG. 5A, the curvature radius S at the position spaced 15 mm apart from the face center C1 toward the toe side is represented by a curvature radius St. As shown in FIG. 5B, the curvature radius S at the position of the face center C1 is represented by a curvature radius Sc. As shown in FIG. 5C, the curvature radius S at the position spaced 15 mm apart from the face center C1 toward the heel side is represented by a curvature radius Sh. For the sake of easy understanding, in the present disclosure, the symbols "S", "St", "Sc", "Sh" and the like are used for showing the kind of curvature radius, and also used as reference symbols in drawings. The unit of these curvature radii is "mm".

The hitting face 10*a* has a face height F. The face height F is measured on a vertical cross-sectional contour line. The face height F is measured at each position in the toe-heel direction. As shown in FIG. 5A, the face height F at the position spaced 15 mm apart from the face center C1 toward the toe side is represented by a face height Ft. As shown in FIG. 5B, the face height F at the position of the face center C1 is represented by a face height Fc. As shown in FIG. 5C, the face height F at the position spaced 15 mm apart from the face center C1 toward the heel side is represented by a face height Fh. For the sake of easy understanding, in the present disclosure, the symbols "F", "Ft", "Fc", "Fh" and the like are used for showing the kind of face height, and also used as reference symbols in drawings. The unit of these face heights is "mm".

The head 4 has a head thickness T. The head thickness T is measured on a vertical cross-sectional contour line. The head thickness T is measured at each position in the toe-heel direction. As shown in FIG. 5A, the head thickness T at the position spaced 15 mm apart from the face center C1 toward the toe side is represented by a head thickness Tt. As shown in FIG. 5B, the head thickness T at the position of the face center C1 is represented by a head thickness Tc. As shown in FIG. 5C, the head thickness T at the position spaced 15 mm apart from the face center C1 toward the heel side is represented by a head thickness Th. For the sake of easy understanding, in the present disclosure, the symbols "T", "Tt", "Tc", "Th" and the like are used for showing the kind of head thickness, and also used as reference symbols in drawings. The unit of these face thicknesses is "mm".

A region that extends from a position spaced 15 mm apart from the face center C1 toward the toe side to a position spaced 15 mm apart from the face center C1 toward the heel side has a high probability of hitting a ball. This region is referred to as a main hitting area.

Figure 6:
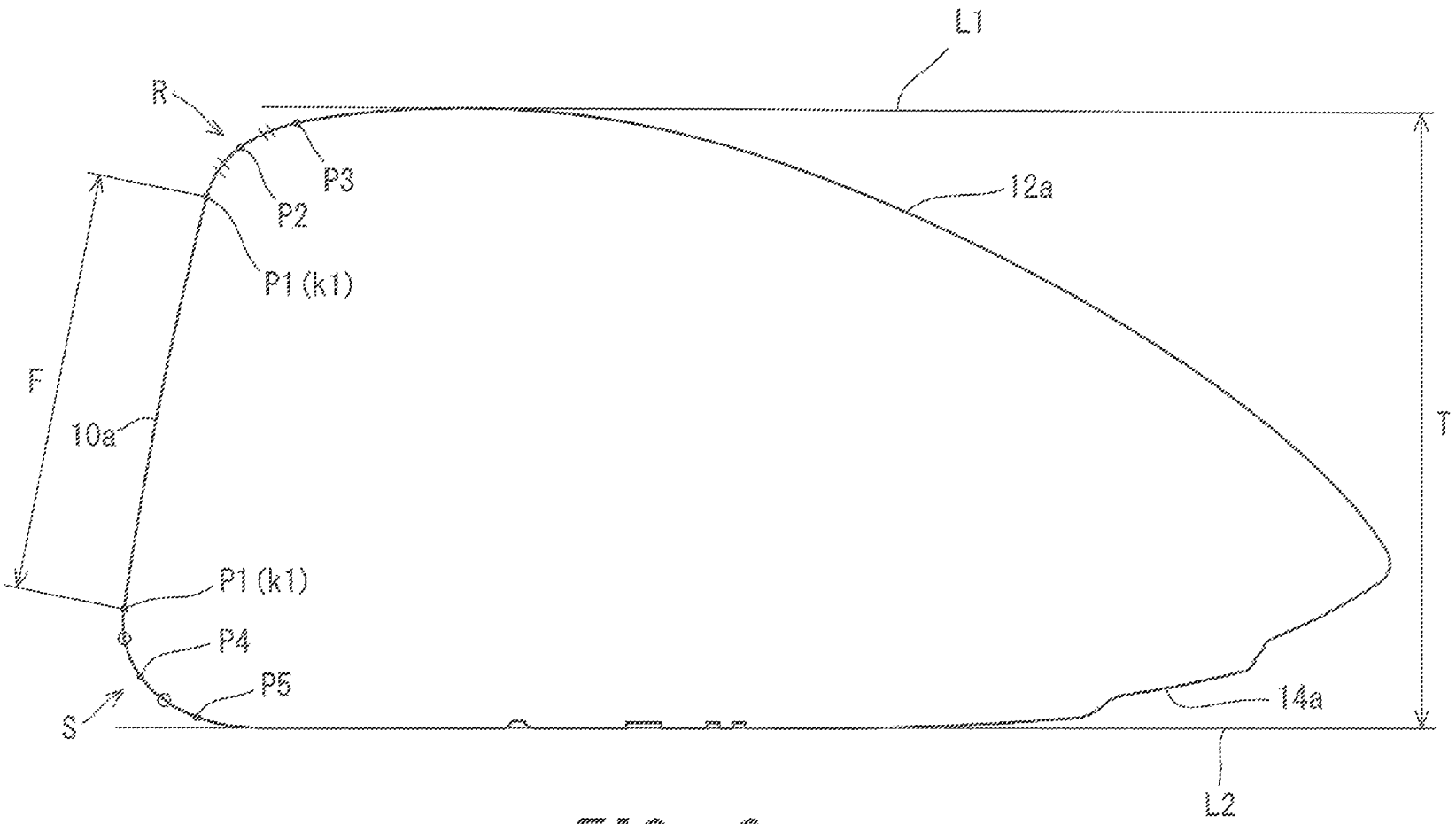
FIG. 6 is an enlarged view of FIG. 5B.

FIG. 6 is an enlarged view of FIG. 5B. Definitions of the curvature radius R, the curvature radius S, the face height F and the head thickness T are explained below with reference to FIG. 6.

The curvature radius R can be defined as follows. In a vertical cross-sectional contour line, a point P2 that has a minimum curvature radius in a portion that extends from the point P1 constituting the outer edge k1 to the crown portion 12 is determined. When this portion does not have a point having a minimum curvature radius, but has a region having a minimum curvature radius, a midpoint of the region is defined as the point P2. This midpoint is determined based on a route length measured along the vertical cross-sectional contour line. Further, a point P3 is disposed on the crown side of the point P2. The point P3 is positioned so that the point P2 becomes the midpoint between the point P3 and the point P1. This midpoint is determined based on the route length. That is, the distance (route length) between the point P2 and the point P3 is equal to the distance (route length) between the point P1 and the point P2. A radius of a circle that passes through the three points P1, P2 and P3 can be defined as the curvature radius R.

The curvature radius S can be defined as follows. In a vertical cross-sectional contour line, a point P4 that has a minimum curvature radius in a portion that extends from the point P1 constituting the outer edge k1 to the sole portion 14 is determined. When this portion does not have a point having a minimum curvature radius, but has a region having a minimum curvature radius, a midpoint of the region is defined as the point P4. This midpoint is determined based on the route length measured along the vertical cross-sectional contour line. Further, a point P5 is disposed on the sole side of the point P4. The point P5 is positioned so that the point P4 becomes the midpoint between the point P5 and the point P1. The distance (route length) between the point P1 and the point P4 is equal to the distance (route length) between the point P4 and the point P5. A radius of a circle that passes through the three points P1, P4 and P5 can be defined as the curvature radius S.

The face height F can be defined as follows. A distance between the point P1 on the upper side and the point P1 on the lower side (shortest distance between the two points on a vertical cross-sectional contour line) can be the face height F.

The head thickness T can be defined as follows. A horizontal straight line L1 that is in contact with the upper side of a vertical cross-sectional contour line, and a horizontal straight line L2 that is in contact with the lower side of the vertical cross-sectional contour line are determined. A distance between the straight line L1 and the straight line L2 can be the head thickness T. The straight line L1 and the straight line L2 are parallel to the ground plane HP. The head thickness T is measured in the up-down direction.

Accordingly, the head thickness T is equivalent to the maximum thickness of the head in a vertical cross section taken at each position in the toe-heel direction. As shown in FIG. 5A to FIG. 5C, the position in the face-back direction of a head upper-most point Pm that is in contact with the straight line L1 varies. A head upper-most point Pm1 (FIG. 5A) in the vertical cross section taken at the position spaced 15 mm apart from the face center C1 toward the toe side is located on the back side with respect to a head upper-most point Pm2 (FIG. 5B) in the vertical cross section taken at the position of the face center C1. The head upper-most point Pm2 (FIG. 5B) in the vertical cross section taken at the position of the face center C1 is located on the back side with respect to a head upper-most point Pm3 in the vertical cross section taken at the position spaced 15 mm apart from the face center C1 toward the heel side. The position of the head upper-most point Pm in the face-back direction goes toward the back side as it goes toward the toe side in the main hitting area.

In the head 4, the curvature radius R on the crown side (hereinafter also referred to as crown-side curvature radius R) is not constant. The curvature radius R varies depending on its position in the toe-heel direction. The curvature radius R varies in a continuous manner. The head 4 satisfies the following relationship (a).

$$Rt > Rc \geq Rh \quad \text{(a)}$$

In the head 4, the curvature radius R (curvature radius Rt) at the position spaced 15 mm apart from the face center C1 toward the toe side is larger than the curvature radius R (curvature radius Rc) at the position of the face center C1. The curvature radius R (curvature radius Rc) at the position of the face center C1 is larger than or equal to the curvature radius R (curvature radius Rh) at the position spaced 15 mm apart from the face center C1 toward the heel side.

The head 4 further satisfies the following relationship (a1).

$$Rt > Rc > Rh \quad \text{(a1)}$$

In the head 4, the curvature radius R (curvature radius Rc) at the position of the face center C1 is larger than the curvature radius R (curvature radius Rh) at the position spaced 15 mm apart from the face center C1 toward the heel side.

In the head 4, the curvature radius S on the sole side (hereinafter also referred to as sole-side curvature radius S) is not constant. The curvature radius S varies depending on its position in the toe-heel direction. The curvature radius S varies in a continuous manner. The head 4 does not satisfy the following relationship (b). The head 4 does not satisfy the following relationship (b1). The head 4 satisfies the following relationship (b2).

$$St > Sc \geq Sh \quad \text{(b)}$$

$$St > Sc > Sh \quad \text{(b1)}$$

$$St < Sc > Sh \quad \text{(b2)}$$

In the head 4, the curvature radius S (curvature radius St) at the position spaced 15 mm apart from the face center C1 toward the toe side is smaller than the curvature radius S (curvature radius Sc) at the position of the face center C1. The curvature radius S (curvature radius Sc) at the position of the face center C1 is larger than the curvature radius S (curvature radius Sh) at the position spaced 15 mm apart from the face center C1 toward the heel side.

As to the head thickness T, the head 4 satisfies the following relationship (c).

$$Tt > Tc > Th \quad \text{(c)}$$

In the head 4, the head thickness T (head thickness Tt) at the position spaced 15 mm apart from the face center C1 toward the toe side is larger than the head thickness T (head thickness Tc) at the position of the face center C1. In the head 4, the head thickness T (head thickness Tc) at the position of the face center C1 is larger than the head thickness T (head thickness Th) at the position spaced 15 mm apart from the face center C1 toward the heel side.

As to the face height F, the head 4 satisfies the following relationship (d).

$$Ft < Fc > Fh \quad \text{(d)}$$

In the head 4, the face height F (face height Ft) at the position spaced 15 mm apart from the face center C1 toward the toe side is smaller than the face height F (face height Fc) at the position of the face center C1. In the head 4, the face height F (face height Fc) at the position of the face center C1 is larger than the face height F (face height Fh) at the position spaced 15 mm apart from the face center C1 toward the heel side.

The increase of the face height Ft is suppressed in the head 4 (driver head). The face height Ft is larger than the face heigh Fh, but is close to the face height Fh. Alternatively, the face height Ft may be smaller than the face height Fh. An absolute value of the difference (Ft–Fh) can be set to be less than or equal to 3 mm, further set to be less than or equal to 2.5 mm, and still further set to be less than or equal to 2 mm.

As to the ratio of the face height F to the head thickness T, the head 4 satisfies the following relationship (e).

$$Ft/Tt < Fh/Th \quad \text{(e)}$$

In the head 4, the ratio (Ft/Tt) of the face height F to the head thickness T at the position spaced 15 mm apart from the face center C1 toward the toe side is smaller than the ratio (Fh/Th) of the face height F to the head thickness T at the position spaced 15 mm apart from the face center C1 toward the heel side.

The head 4 further satisfies the following relationships (f) and (f1).

$$Ft/Tt < Fc/Tc \leq Fh/Th \quad \text{(f)}$$

$$Ft/Tt < Fc/Tc < Fh/Th \quad \text{(f1)}$$

In the head 4, the ratio (Ft/Tt) of the face height F to the head thickness T at the position spaced 15 mm apart from the face center C1 toward the toe side is smaller than the ratio (Fc/Tc) of the face height F to the head thickness T at the position of the face center C1. In the head 4, the ratio (Fc/Tc) of the face height F to the head thickness T at the position of the face center C1 is smaller than the ratio (Fh/Th) of the face height F to the head thickness T at the position spaced 15 mm apart from the face center C1 toward the heel side.

In the head 4, the curvature radius St is smaller than the curvature radius Rt. That is, the sole-side curvature radius S (curvature radius St) is smaller than the crown-side curvature radius R (curvature radius Rt) at the position spaced 15 mm apart from the face center C1 toward the toe side. In the head 4, the curvature radius Sc is smaller than the curvature radius Rc. That is, the sole-side curvature radius S (curvature radius Sc) is smaller than the crown-side curvature radius R (curvature radius Rc) at the position of the face center C1. In the head 4, the curvature radius Sh is larger than the curvature radius Rh. That is, the sole-side curvature radius S (curvature radius Sh) is larger than the crown-side curvature radius R (curvature radius Rh) at the position spaced 15 mm apart from the face center C1 toward the heel side.

The first embodiment is an example of a driver head and can have the following dimensions.

Figure 7:
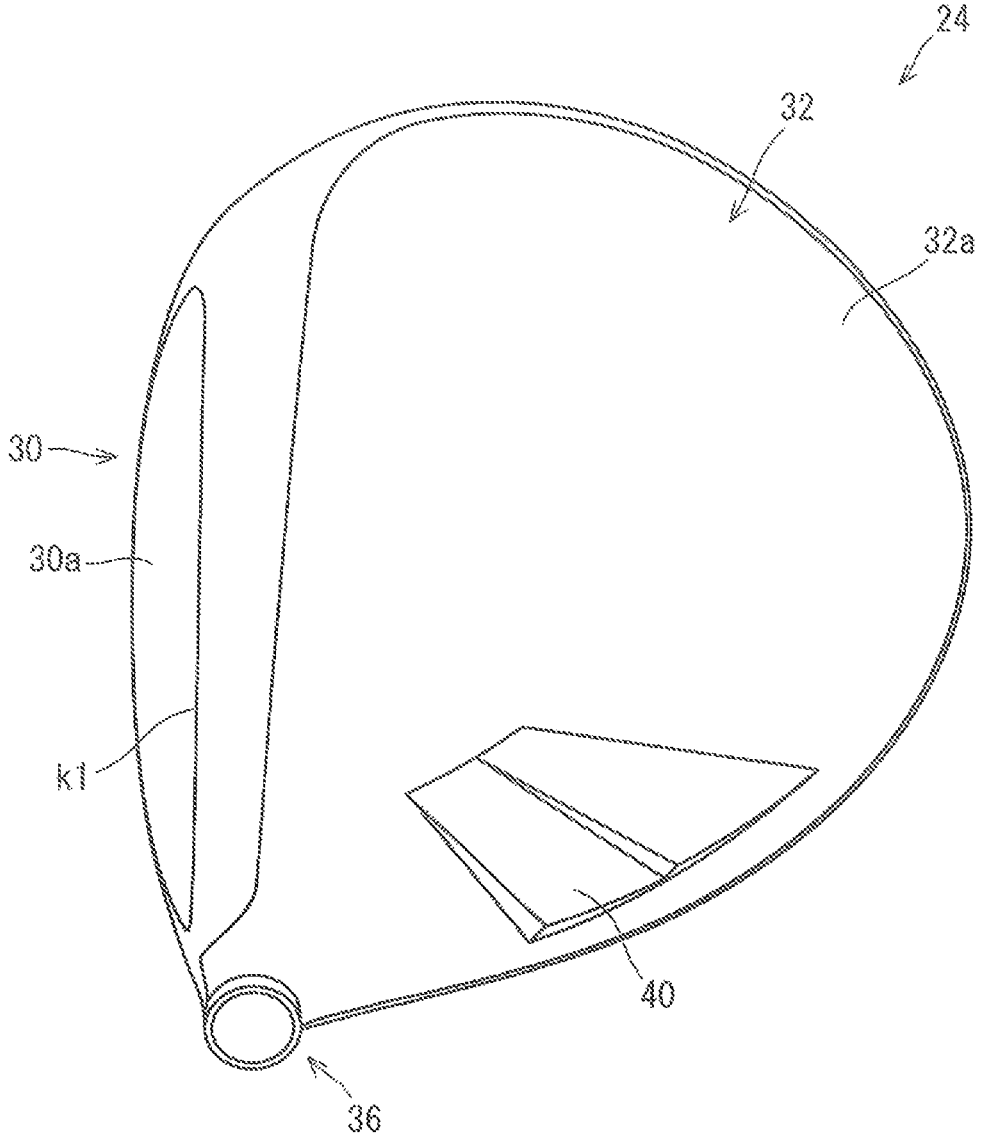
FIG. 7 is a plan view of a head according to a second embodiment as viewed from the crown side.
Figure 8:
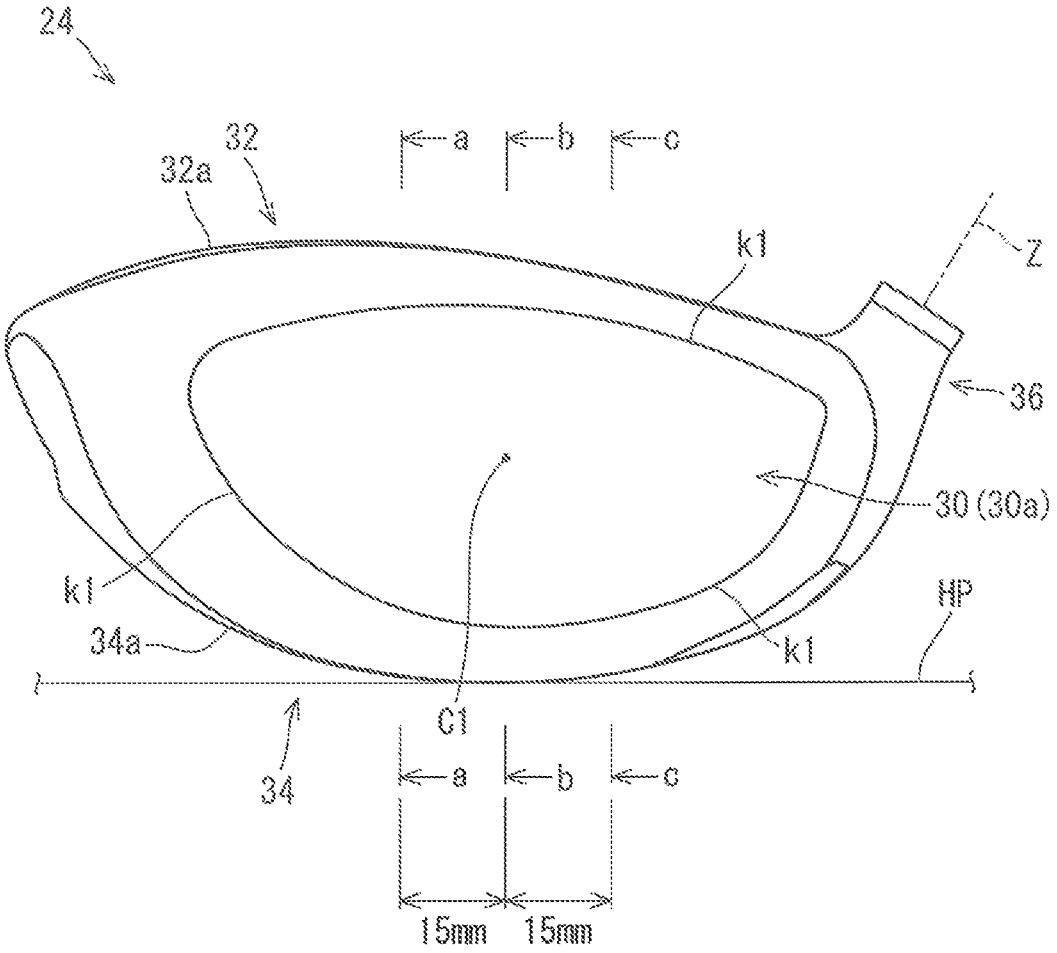
FIG. 8 is a front view of the head of the second embodiment as viewed from the face side.
Figure 9A:
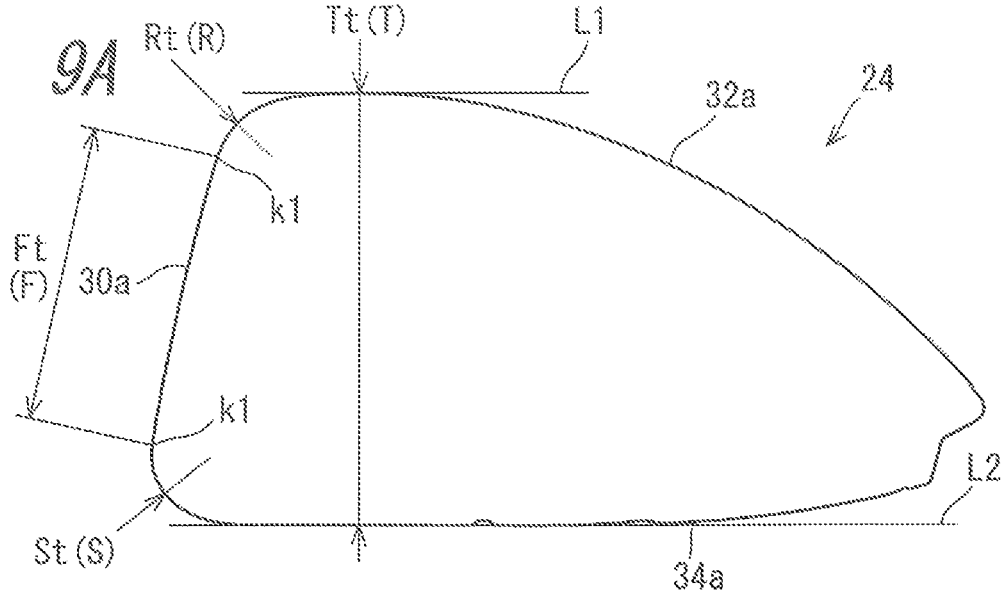
FIG. 9A shows a cross-sectional contour line of the head outer surface in a cross-sectional view taken along line a-a in FIG. 8.
Figure 9B:
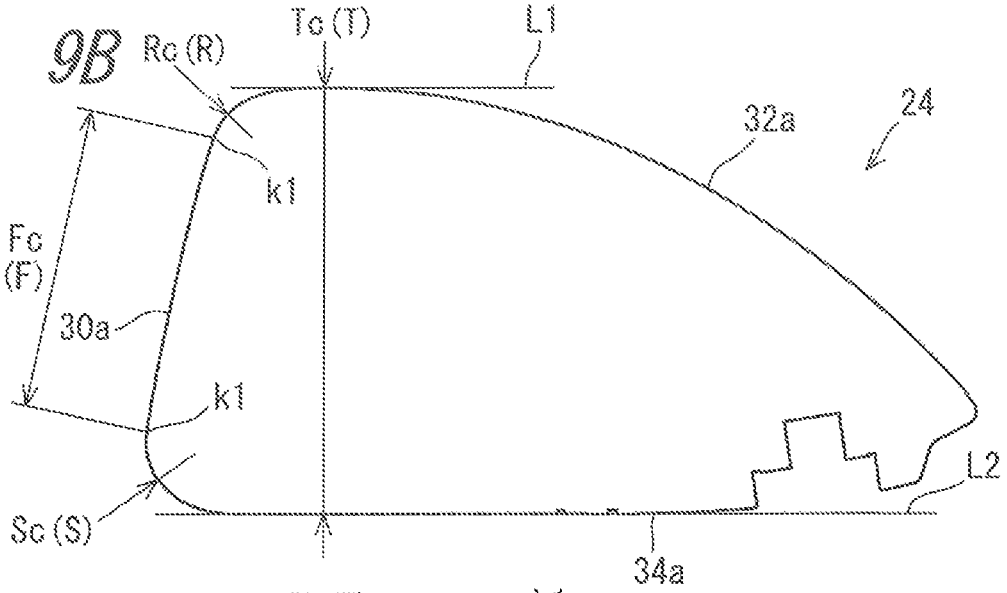
FIG. 9B shows a cross-sectional contour line of the head outer surface in a cross-sectional view taken along line b-b in FIG. 8.
Figure 9C:
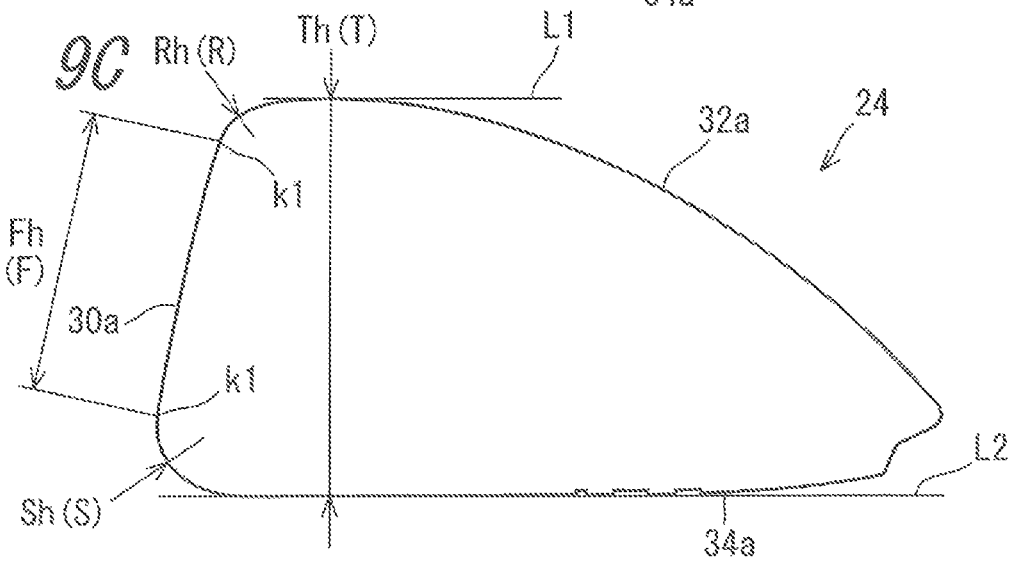
FIG. 9C shows a cross-sectional contour line of the head outer surface in a cross-sectional view taken along line c-c in FIG. 8.

Crown-side curvature radius Rt: 11.94 mm
Crown-side curvature radius Rc: 9.43 mm
Crown-side curvature radius Rh: 7.76 mm
Sole-side curvature radius St: 9.01 mm
Sole-side curvature radius Sc: 9.38 mm
Sole-side curvature radius Sh: 9.16 mm
Face height Ft: 38.06 mm
Face height Fc: 39.27 mm
Face height Fh: 37.25 mm
Head thickness Tt: 58.84 mm
Head thickness Tc: 58.01 mm
Head thickness Th: 53.80 mm FIG. 7 is a plan view of a head 24 according to a second embodiment as viewed from above. FIG. 8 is a front view of the head 24. FIG. 8 shows the head 24 which is in the reference state as viewed from the face side. FIG. 9A is a cross-sectional view taken along line a-a in FIG. 8. FIG. 9B is a cross-sectional view taken along line b-b in FIG. 8. FIG. 9C is a cross-sectional view taken along line c-c in FIG. 8. FIG. 9A, FIG. 9B and FIG. 9C each show a vertical cross-sectional contour line. FIG. 9A shows a vertical cross-sectional contour line at a position spaced 15 mm apart from the face center C1 toward the toe side. FIG. 9B shows a vertical cross-sectional contour line at a position of the face center C1. FIG. 9C shows a vertical cross-sectional contour line at a position spaced 15 mm apart from the face center C1 toward the heel side.

The head 24 includes a face portion 30, a crown portion 32, a sole portion 34, and a hosel portion 36. The face portion 30 includes a hitting face 30*a*. The hitting face 30*a* is constituted by the outer surface of the face portion 30. The hitting face 30*a* is a curved surface that is convex toward the outside of the head 24. The hitting face 30*a* includes a face bulge and a face roll. The crown portion 32 forms a crown surface 32*a*. The sole portion 34 forms a sole surface 34*a*. The hitting face 30*a*, the crown surface 32*a* and the sole surface 34*a* constitute the head outer surface. The head 24 is hollow. The head 24 is a driver head.

As shown in FIG. 7, the crown portion 32 includes a crown protrusion 40. The crown protrusion 40 forms a protrusion on the crown surface 32*a*. The crown protrusion 40 is not viewable in the front view (FIG. 8) of the head 24 as viewed from the face side. The entirety of the crown protrusion 40 is positioned on the heel side with respect to the face center C1.

In the head 24, the crown-side curvature radius R is not constant. The curvature radius R varies depending on its position in the toe-heel direction. The curvature radius R varies in a continuous manner. The head 24 satisfies the following relationship (a). The head 24 further satisfies the following relationship (a1).

$$Rt > Rc \geq Rh \quad \text{(a)}$$

$$Rt > Rc > Rh \quad \text{(a1)}$$

In the head 24, the sole-side curvature radius S is not constant. The curvature radius S varies depending on its position in the toe-heel direction. The curvature radius S varies in a continuous manner. The head 24 does not satisfy the following relationship (b). The head 24 does not satisfy the following relationship (b1). The head 24 satisfies the following relationship (b2). The increase of the curvature radius St can be suppressed by the relationship (b2).

$$St > Sc \geq Sh \quad \text{(b)}$$

$$St > Sc > Sh \quad \text{(b1)}$$

$$St < Sc > Sh \quad \text{(b2)}$$

As to the head thickness T, the head 24 satisfies the following relationship (c).

$$Tt > Tc > Th \quad \text{(c)}$$

As to the face height F, the head 24 satisfies the following relationship (d).

$$Ft < Fc > Fh \quad \text{(d)}$$

As to the ratio of the face height F to the head thickness T, the head 24 satisfies the following relationship (e).

$$Ft/Tt < Fh/Th \quad \text{(e)}$$

The head 24 satisfies the following relationship (f). The head 24 does not satisfy the following relationship (f1). In the head 24, the ratio (Fc/Tc) at the center is equal to the ratio (Fh/Th) on the heel side.

$$Ft/Tt < Fc/Tc \leq Fh/Th \quad \text{(f)}$$

$$Ft/Tt < Fc/Tc < Fh/Th \quad \text{(f1)}$$

In the head 24, the curvature radius St is smaller than the curvature radius Rt. The curvature radius Sc is smaller than the curvature radius Rc. The curvature radius Sh is larger than the curvature radius Rh.

The second embodiment is another example of a driver head and has the following dimensions.

Figure 10:
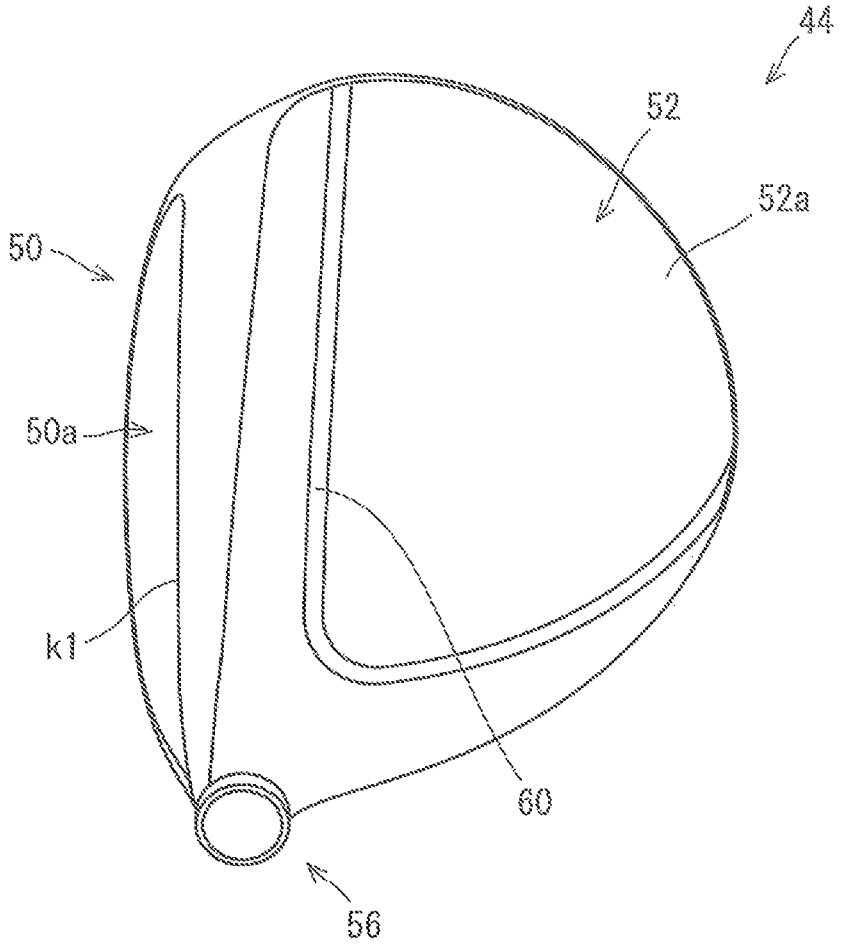
FIG. 10 is a plan view of a head according to a third embodiment as viewed from the crown side.
Figure 11:
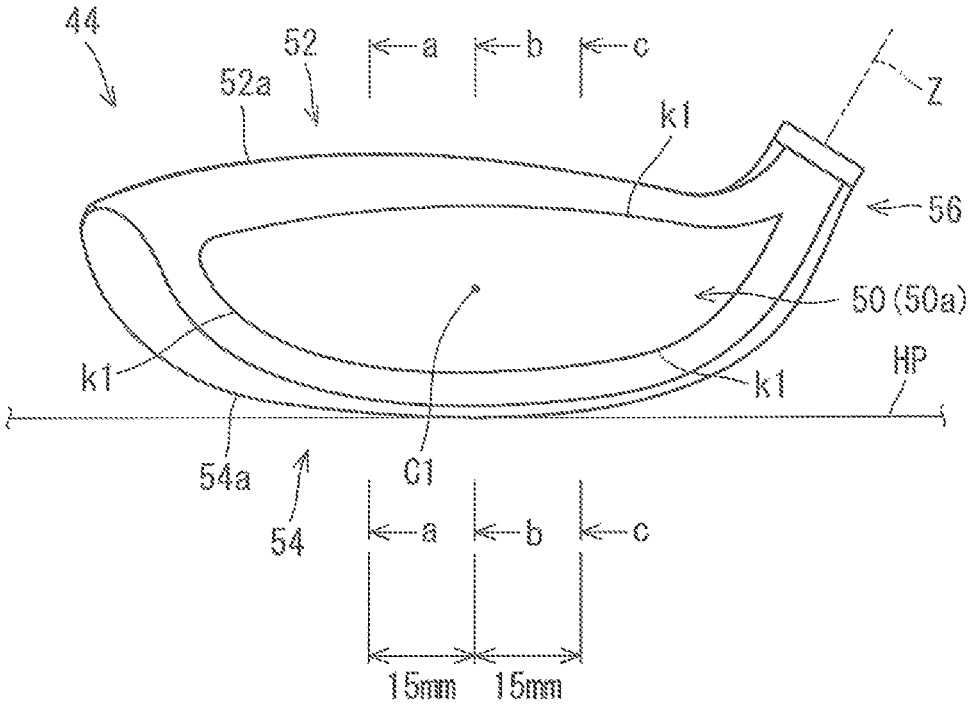
FIG. 11 is a front view of the head of the third embodiment as viewed from the face side.
Figure 12A:
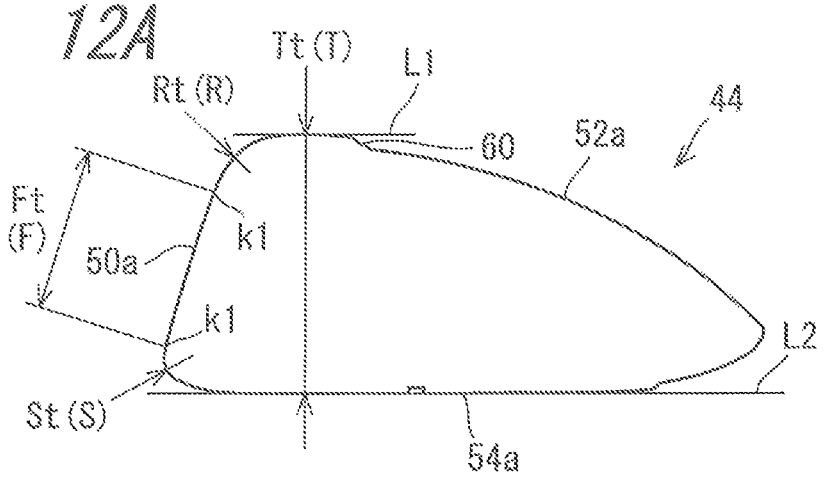
FIG. 12A shows a cross-sectional contour line of the head outer surface in a cross-sectional view taken along line a-a in FIG. 11.
Figure 12B:
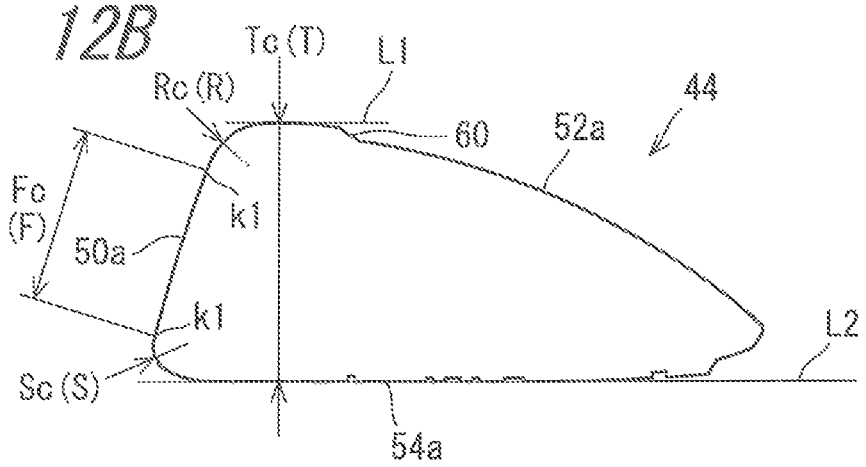
FIG. 12B shows a cross-sectional contour line of the head outer surface in a cross-sectional view taken along line b-b in FIG. 11.
Figure 12C:
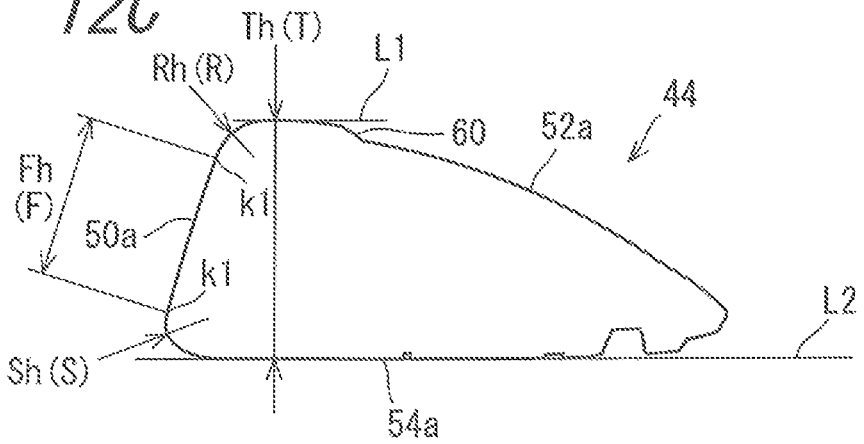
FIG. 12C shows a cross-sectional contour line of the head outer surface in a cross-sectional view taken along line c-c in FIG. 11.

Crown-side curvature radius Rt: 11.40 mm
Crown-side curvature radius Rc: 9.43 mm
Crown-side curvature radius Rh: 7.99 mm
Sole-side curvature radius St: 8.89 mm
Sole-side curvature radius Sc: 9.30 mm
Sole-side curvature radius Sh: 9.08 mm
Face height Ft: 41.58 mm
Face height Fc: 42.41 mm
Face height Fh: 39.42 mm
Head thickness Tt: 60.75 mm
Head thickness Tc: 59.91 mm
Head thickness Th: 55.69 mm FIG. 10 is a plan view of a head 44 according to a third embodiment as viewed from above. FIG. 11 is a front view of the head 44. FIG. 11 shows the head 44 which is in the reference state as viewed from the face side. FIG. 12A is a cross-sectional view taken along line a-a in FIG. 11. FIG. 12B is a cross-sectional view taken along line b-b in FIG. 11. FIG. 12C is a cross-sectional view taken along line c-c in FIG. 11. FIG. 12A, FIG. 12B and FIG. 12C each show a vertical cross-sectional contour line. FIG. 12A shows a vertical cross-sectional contour line at a position spaced 15 mm apart from the face center C1 toward the toe side. FIG. 12B shows a vertical cross-sectional contour line at a position of the face center C1. FIG. 12C shows a vertical cross-sectional contour line at a position spaced 15 mm apart from the face center C1 toward the heel side.

The head 44 includes a face portion 50, a crown portion 52, a sole portion 54, and a hosel portion 56. The face portion 50 includes a hitting face 50*a*. The hitting face 50*a* is constituted by the outer surface of the face portion 50. The hitting face 50*a* is a curved surface that is convex toward the outside of the head 44. The hitting face 50*a* includes a face bulge and a face roll. The crown portion 52 forms a crown surface 52*a*. The sole portion 54 forms a sole surface 54*a*. The hitting face 50*a*, the crown surface 52*a* and the sole surface 54*a* constitute the head outer surface. The head 44 is hollow. The head 44 is a fairway wood type head. The head 44 is a number 5 wood.

As shown in FIG. 10, the crown portion 52 includes a crown step 60. The crown step 60 forms a step on the crown surface 52*a*. As shown in FIG. 12A, (in the vertical cross section taken) at the position spaced 15 mm apart from the face center C1 toward the toe side, the crown step 60 constitutes a step that makes its face side higher than its back side. As shown in FIG. 12B, (in the vertical cross section taken) at the position of the face center C1, the crown step 60 constitutes a step that makes its face side higher than its back side. As shown in FIG. 12C, (in the vertical cross section taken) at the position spaced 15 mm apart from the face center C1 toward the heel side, the crown step 60 constitutes a step that makes its face side higher than its back side. The crown step 60 constitutes a step that makes its face side higher than its back side in the entirety of the main hitting area. The crown step 60 allows the crown portion 52 to easily expand and contract in the face-back direction. The crown step 60 can contribute to improvement in rebound performance.

In the head 44, the crown-side curvature radius R is not constant. The curvature radius R varies depending on its position in the toe-heel direction.

The curvature radius R varies in a continuous manner. The head 44 satisfies the following relationship (a). The head 44 further satisfies the following relationship (a1).

$$Rt > Rc \geq Rh \quad \text{(a)}$$

$$Rt > Rc > Rh \quad \text{(a1)}$$

In the head 44, the sole-side curvature radius S is not constant. The curvature radius S varies depending on its position in the toe-heel direction. The curvature radius S varies in a continuous manner. The head 44 does not satisfy the following relationship (b). The head 44 does not satisfy the following relationship (b1). The head 44 does not satisfy the following relationship (b2). The head 44 satisfies the following relationship (b3). In the head 44, the curvature radius St is smaller than the curvature radius Sc. In the head 44, the curvature radius Sc is smaller than the curvature radius Sh. The relationship (b3) can suppress the increase of the curvature radius St.

$$St > Sc \geq Sh \quad \text{(b)}$$

$$St > Sc > Sh \quad \text{(b1)}$$

$$St < Sc > Sh \quad \text{(b2)}$$

$$St < Sc < Sh \quad \text{(b3)}$$

As to the head thickness T, the head 44 does not satisfy the following relationship (c). The head 44 satisfies the following relationship (c1). In the head 44, the head thickness Tt is smaller than the head thickness Tc. In the head 44, the head thickness Tc is larger than the head thickness Th.

$$Tt > Tc > Th \quad \text{(c)}$$

$$Tt < Tc > Th \quad \text{(c1)}$$

In the head 44 (fairway wood type head), the difference between the head thickness Tt and the head thickness Th can be smaller as compared with that of a driver head. The difference (Tt–Th) can be set to be less than or equal to 5.0 mm, further set to be less than or equal to 4.5 mm, and still further set to be less than or equal to 4.0 mm. The difference (Tt–Th) can be set to be greater than or equal to 1.0 mm, further set to be greater than or equal to 1.5 mm, and still further set to be greater than or equal to 2.0 mm.

As to the face height F, the head 44 satisfies the following relationship (d).

$$Ft < Fc > Fh \quad \text{(d)}$$

In the head 44 (fairway wood type head), the increase of the face height Ft is suppressed and the face height Ft is close to the face height Fh. The face height Ft is smaller than the face height Fc. The face height Ft is larger than the face height Fh. The face height Ft, however, is substantially equal to the face height Fh. Alternatively, the face height Ft may be smaller than the face height Fh. An absolute value of the difference (Ft–Fh) can be set to be less than or equal to 1.5 mm, further set to be less than or equal to 1.0 mm, and still further set to be less than or equal to 0.5 mm.

As to the ratio of the face height F to the head thickness T, the head 44 satisfies the following relationship (e).

$$Ft/Tt < Fh/Th \quad \text{(e)}$$

The head 44 further satisfies the following relationships (f) and (f1).

$$Ft/Tt < Fc/Tc \leq Fh/Th \quad \text{(f)}$$

$$Ft/Tt < Fc/Tc < Fh/Th \quad \text{(f1)}$$

In the head 44, the curvature radius St is smaller than the curvature radius Rt. In the head 44, the curvature radius Sc is smaller than the curvature radius Rc. In the head 44, the curvature radius Sh is smaller than the curvature radius Rh.

The third embodiment is an example of a fairway wood type head and can have the following dimensions.

Figure 13:
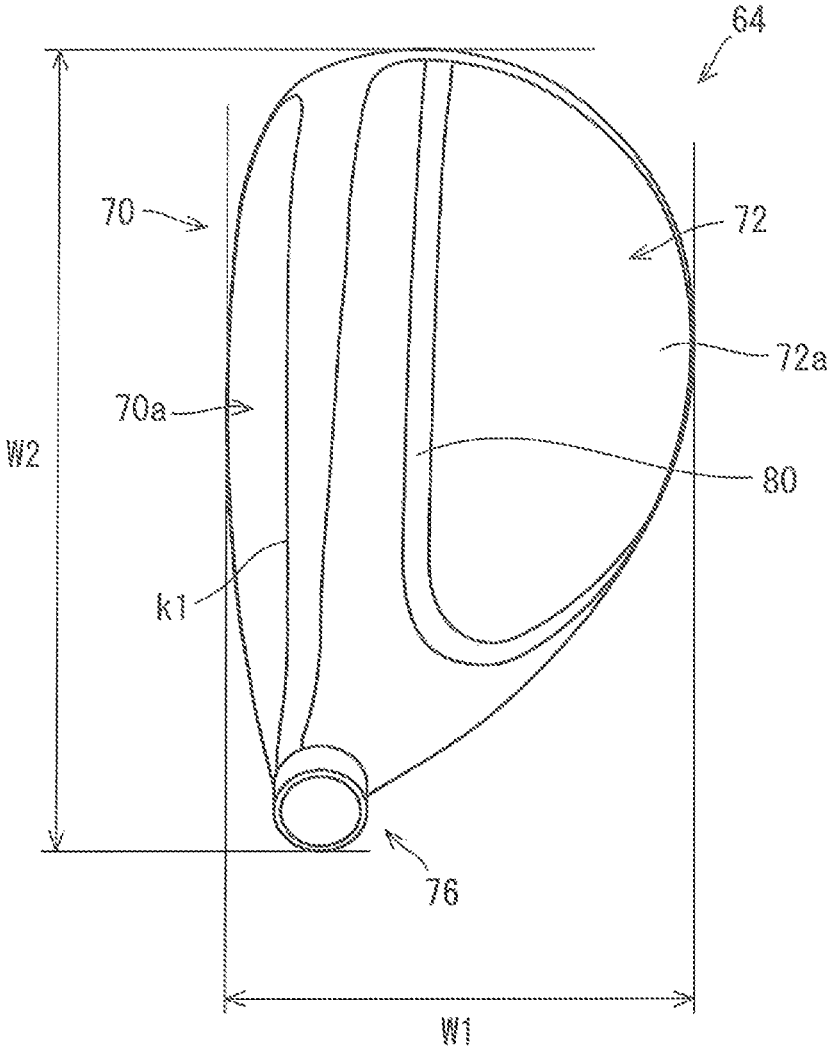
FIG. 13 is a plan view of a head according to a fourth embodiment as viewed from the crown side.
Figure 14:
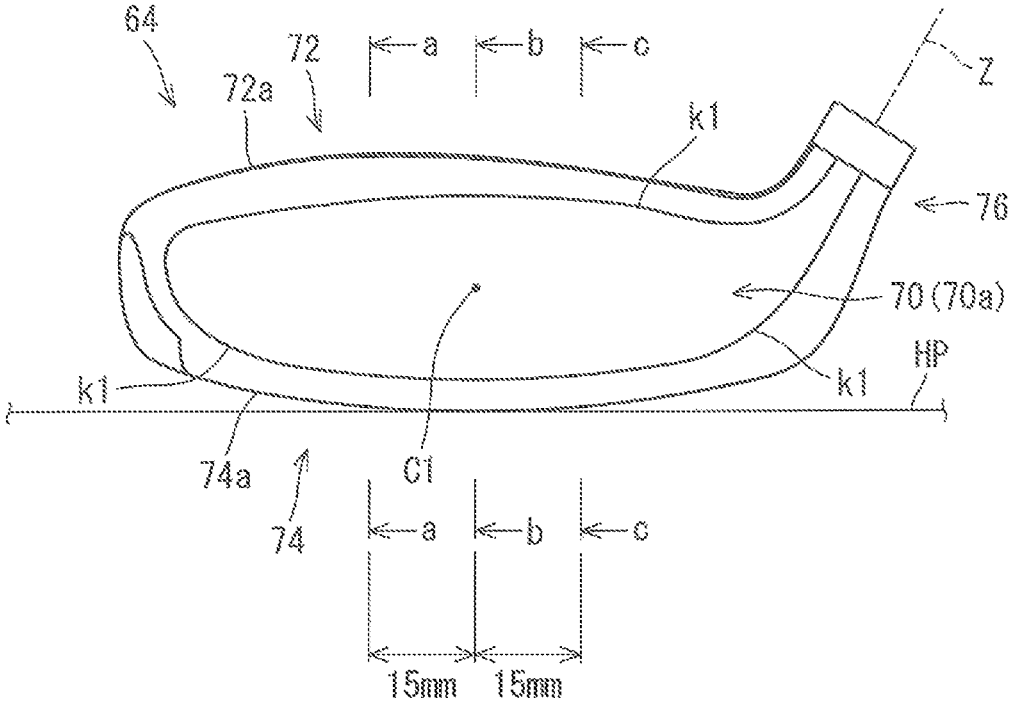
FIG. 14 is a front view of the head of the fourth embodiment as viewed from the face side.
Figure 15A:
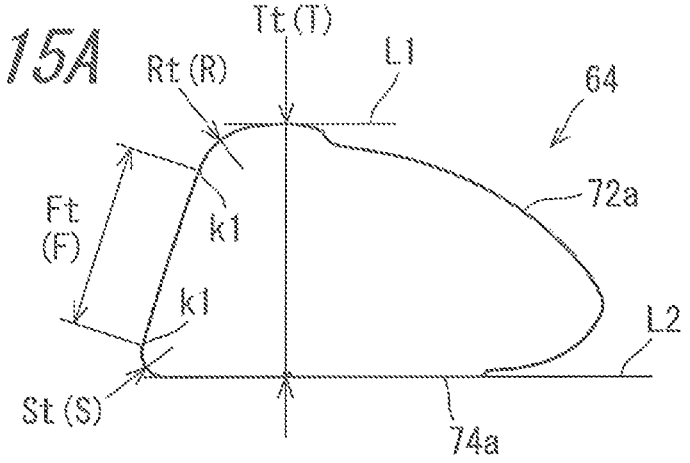
FIG. 15A shows a cross-sectional contour line of the head outer surface in a cross-sectional view taken along line a-a in FIG. 14.
Figure 15B:
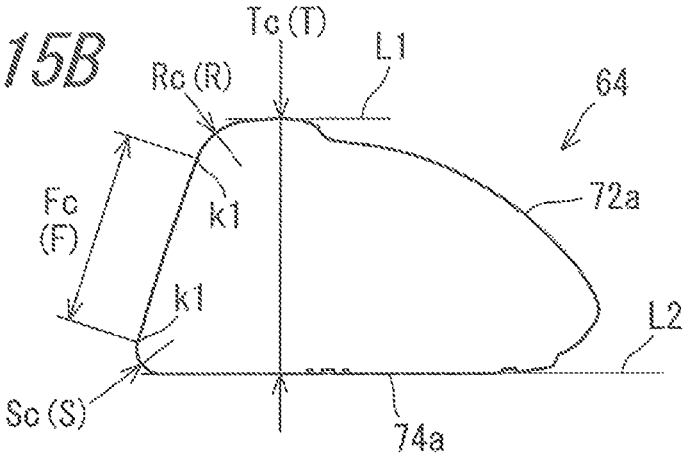
FIG. 15B shows a cross-sectional contour line of the head outer surface in a cross-sectional view taken along line b-b in FIG. 14.
Figure 15C:
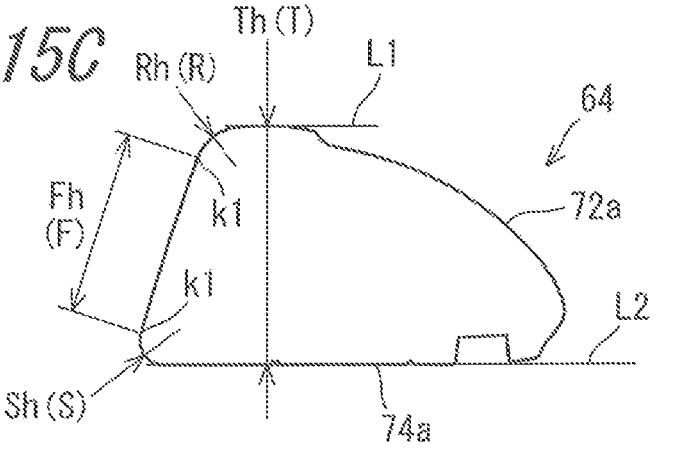
FIG. 15C shows a cross-sectional contour line of the head outer surface in a cross-sectional view taken along line c-c in FIG. 14.

Crown-side curvature radius Rt: 12.33 mm
Crown-side curvature radius Rc: 10.11 mm
Crown-side curvature radius Rh: 7.72 mm
Sole-side curvature radius St: 3.25 mm
Sole-side curvature radius Sc: 3.47 mm
Sole-side curvature radius Sh: 3.63 mm
Face height Ft: 22.81 mm
Face height Fc: 24.46 mm
Face height Fh: 22.72 mm
Head thickness Tt: 36.37 mm
Head thickness Tc: 36.39 mm
Head thickness Th: 33.45 mm FIG. 13 is a plan view of a head 64 according to a fourth embodiment as viewed from above. FIG. 14 is a front view of the head 64. FIG. 14 shows the head 64 which is in the reference state as viewed from the face side. FIG. 15A is a cross-sectional view taken along line a-a in FIG. 14. FIG. 15B is a cross-sectional view taken along line b-b in FIG. 14. FIG. 15C is a cross-sectional view taken along line c-c in FIG. 14. FIG. 15A, FIG. 15B and FIG. 15C each show a vertical cross-sectional contour line. FIG. 15A shows a vertical cross-sectional contour line at a position spaced 15 mm apart from the face center C1 toward the toe side. FIG. 15B shows a vertical cross-sectional contour line at a position of the face center C1. FIG. 15C shows a vertical cross-sectional contour line at a position spaced 15 mm apart from the face center C1 toward the heel side.

The head 64 includes a face portion 70, a crown portion 72, a sole portion 74, and a hosel portion 76. The face portion 70 includes a hitting face 70*a*. The hitting face 70*a* is constituted by the outer surface of the face portion 70. The hitting face 70*a* is a curved surface that is convex toward the outside of the head 64. The hitting face 70*a* includes a face bulge and a face roll. The crown portion 72 forms a crown surface 72*a*. The sole portion 74 forms a sole surface 74*a*. The hitting face 70*a*, the crown surface 72*a* and the sole surface 74*a* constitute the head outer surface. The head 64 is hollow. The head 64 is a hybrid type head.

As shown in FIG. 13, the crown portion 72 includes a crown step 80. The crown step 80 forms a step on the crown surface 72*a*. As shown in FIG. 15A, (in the vertical cross section taken) at the position spaced 15 mm apart from the face center C1 toward the toe side, the crown step 80 constitutes a step that makes its face side higher than its back side. As shown in FIG. 15B, (in the vertical cross section taken) at the position of the face center C1, the crown step 80 constitutes a step that makes its face side higher than its back side. As shown in FIG. 15C, (in the vertical cross section taken) at the position spaced 15 mm apart from the face center C1 toward the heel side, the crown step 80 constitutes a step that makes its face side higher than its back side.

In the head 64, the crown-side curvature radius R is not constant. The curvature radius R varies depending on its position in the toe-heel direction. The curvature radius R varies in a continuous manner. The head 64 satisfies the following relationship (a). The head 64 further satisfies the following relationship (a1).

$$Rt > Rc \geq Rh \quad \text{(a)}$$

$$Rt > Rc > Rh \quad \text{(a1)}$$

In the head 64, the sole-side curvature radius S is not constant. The curvature radius S varies depending on its position in the toe-heel direction.

The curvature radius S varies in a continuous manner. The head 64 does not satisfy the following relationship (b). The head 64 does not satisfy the following relationship (b1). The head 64 does not satisfy the following relationship (b3). The head 64 satisfies the following relationship (b2).

$$St > Sc \geq Sh \quad \text{(b)}$$

$$St > Sc > Sh \quad \text{(b1)}$$

$$St < Sc > Sh \quad \text{(b2)}$$

$$St < Sc < Sh \quad \text{(b3)}$$

As to the head thickness T, the head 64 does not satisfy the following relationship (c). The head 64 satisfies the following relationship (c1).

$$Tt > Tc > Th \quad \text{(c)}$$

$$Tt < Tc > Th \quad \text{(c1)}$$

The head thickness Tt is larger than the head thickness Th. In the head 64 (hybrid type head), the difference between the head thickness Tt and the head thickness Th can be smaller as compared with that of a driver head. The difference (Tt–Th) can be set to be less than or equal to 4.0 mm, further set to be less than or equal to 3.5 mm, and still further set to be less than or equal to 3.0 mm. The difference (Tt–Th) can be set to be greater than or equal to 0.5 mm, further set to be greater than or equal to 1.0 mm, and still further set to be greater than or equal to 1.5 mm.

As to the face height F, the head 64 satisfies the following relationship (d).

$$Ft < Fc > Fh \quad \text{(d)}$$

In the head 64 (hybrid type head), the increase of the face height Ft is suppressed and the face height Ft is close to the face height Fh. The face height Ft is smaller than the face height Fc. The face height Ft is smaller than the face height Fh. The face height Ft is substantially equal to the face height Fh. Alternatively, the face height Ft may be larger than the face height Fh. An absolute value of the difference (Ft–Fh) can be set to be less than or equal to 2.0 mm, further set to be less than or equal to 1.5 mm, and still further set to be less than or equal to 1.0 mm.

As to the ratio of the face height F to the head thickness T, the head 64 satisfies the following relationship (e).

$$Ft/Tt < Fh/Th \quad \text{(e)}$$

The head 64 further satisfies the following relationships (f) and (f1).

$$Ft/Tt < Fc/Tc \leq Fh/Th \quad \text{(f)}$$

$$Ft/Tt < Fc/Tc < Fh/Th \quad \text{(f1)}$$

In the head 64, the curvature radius St is smaller than the curvature radius Rt. The curvature radius Sc is smaller than the curvature radius Rc. The curvature radius Sh is smaller than the curvature radius Rh.

The fourth embodiment is an example of a hybrid type head and can have the following dimensions.

Figure 16:
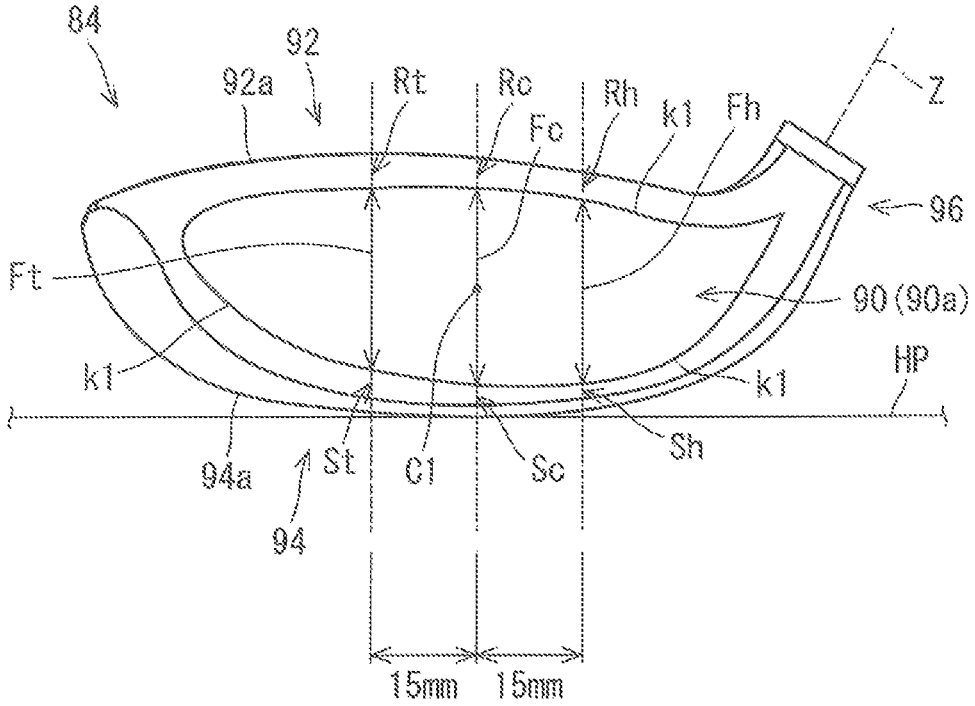
FIG. 16 is a front view of a head according to a fifth embodiment as viewed from the face side.

Crown-side curvature radius Rt: 9.50 mm
Crown-side curvature radius Rc: 8.02 mm
Crown-side curvature radius Rh: 6.50 mm
Sole-side curvature radius St: 3.49 mm
Sole-side curvature radius Sc: 3.50 mm
Sole-side curvature radius Sh: 3.49 mm
Face height Ft: 25.85 mm
Face height Fc: 27.14 mm
Face height Fh: 25.87 mm
Head thickness Tt: 35.57 mm
Head thickness Tc: 35.83 mm
Head thickness Th: 33.49 mm FIG. 16 is a front view of a head 84 according to a fifth embodiment. The head 84 includes a face portion 90, a crown portion 92, a sole portion 94, and a hosel portion 96. The face portion 90 includes a hitting face 90*a*. The crown portion 92 forms a crown surface 92*a*. The sole portion 94 forms a sole surface 94*a*. The head 84 is hollow. The head 84 is a fairway wood type head.

In the head 84, the crown-side curvature radius R slightly varies or is constant. The range of variation of the curvature radius R in the main hitting area can be set to be less than or equal to 1.0 mm, further set to be less than or equal to 0.8 mm, still further set to be less than or equal to 0.6 mm, and yet further set to be less than or equal to 0.4 mm. The head 84 does not satisfy the following relationship (a) or (a1). Alternatively, the head 84 may satisfy the following relationship (a) and/or (a1).

$$Rt > Rc \geq Rh \quad \text{(a)}$$

$$Rt > Rc > Rh \quad \text{(a1)}$$

In the head 84, the sole-side curvature radius S is not constant. The curvature radius S varies depending on its position in the toe-heel direction. The curvature radius S varies in a continuous manner. The head 84 satisfies the following relationship (b). The head 84 satisfies the following relationship (b1).

$$St > Sc \geq Sh \quad \text{(b)}$$

$$St > Sc > Sh \quad \text{(b1)}$$

Except for the curvature radius R and the curvature radius S, the head 84 is the same as the head 44 of the third embodiment. In the head 44, the range of variation of the curvature radius R is wider than the range of variation of the curvature radius S. In the head 84, however, the range of variation of the curvature radius S is wider than the range of variation of the curvature radius R.

As to the face height F, the head 84 does not satisfy the following relationship (d). The head 84 satisfies the following relationship (d1).

$$Ft < Fc > Fh \quad \text{(d)}$$

$$Ft < Fc < Fh \quad \text{(d1)}$$

The head 84 (fairway wood type head) has a large curvature radius St and a small face height Ft. The face height Ft is smaller than the face height Fh.

As to the ratio of the face height F to the head thickness T, the head 84 satisfies the following relationship (e).

$$Ft/Tt < Fh/Th \quad \text{(e)}$$

The head 84 further satisfies the following relationships (f) and (f1).

$$Ft/Tt < Fc/Tc \leq Fh/Th \quad \text{(f)}$$

$$Ft/Tt < Fc/Tc < Fh/Th \quad \text{(f1)}$$

In the head 84, the curvature radius St is smaller than the curvature radius Rt. The curvature radius Sc is smaller than the curvature radius Rc. The curvature radius Sh is smaller than the curvature radius Rh.

The above-described embodiments exhibit the following advantageous effects.

By satisfying the following relationship (a) and/or relationship (b), and increasing the curvature radius Rt and/or curvature radius St on the toe side, the increase of the face height Ft is suppressed and the following relationship (e) can be satisfied. In this case, since the boundary portion(s) (portion having the curvature radius Rt and/or portion having the curvature radius St) having a large curvature radius bends, and the head has a small face height Ft, a load applied to the face portion is reduced when the head hits a ball at a toe-side position. This improves durability of the head (hereinafter, this advantageous effect is referred to as toe durability improvement effect). The small face height Ft can reduce the amount of bending of the face portion, which can lead to deterioration of rebound performance. However, since the boundary portion(s) having a large curvature radius Rt and/or having a large curvature radius St bends, the overall amount of bending in the toe-side part of the head can be maintained. Accordingly, the rebound performance can be maintained (hereinafter, this advantageous effect is referred to as toe rebound performance maintaining effect). On the other hand, the heel-side part of a head has a small face height Fh as a basic head structure, which is advantageous in durability. The head can have a sufficient face height Fh by reducing the curvature radius Rh and/or curvature radius Sh. Such a sufficient face height Fh leads to a sufficient bending of the heel-side part of the face portion 10, which can enhance the rebound performance (hereinafter this advantageous effect is referred to as heel rebound performance improvement effect). In addition, the viewable area of the hitting face is not narrowed by maintaining the sufficient face height Fh on the heel side, which can afford a golfer a feeling of relief when addressing a golf ball with the head. From these viewpoints, it is more preferable that the following relationship(s) (a1) and/or (b1) is satisfied.

$$Rt > Rc \geq Rh \quad \text{(a)}$$

$$St > Sc \geq Sh \quad \text{(b)}$$

$$Rt > Rc > Rh \quad \text{(a1)}$$

-continued $$St > Sc > Sh \quad \text{(b1)}$$

$$Ft/Tt < Fh/Th \quad \text{(e)}$$

The above-described advantageous effects are enhanced in an actual hitting of a golf ball by satisfying the above relationship(s) in the main hitting area.

The first, second, third and fourth embodiments satisfy the above relationship (a) or (a1), and satisfy the above relationship (e). For this reason, the boundary portion on the crown side which has a large curvature radius Rt bends when hitting a ball at a toe-side position of the head, and the increase of the face height Ft on the toe side is suppressed. This reduces a load applied on the toe-side part of the face portion, and improves durability of the head (toe durability improvement effect). A small face height Ft can reduce the amount of bending of the face portion and can worsen the rebound performance. However, a portion having a curvature radius of Rt bends, and thus the overall amount of bending in the toe-side part of the head can be maintained. Accordingly, the rebound performance in the toe-side part of the head can be maintained (toe rebound performance maintaining effect). On the other hand, the heel-side part of a head usually has a small face height Fh, which is advantageous in durability. The head can have a sufficient face height Fh by reducing the curvature radius Rh. Such a sufficient face height Fh can bring about a sufficient bending in the heel-side part of the face portion, which can enhance the rebound performance (heel rebound performance improvement effect). These advantageous effects can improve the rebound performance and durability in the entirety of the face portion. In addition, the viewable area of the hitting face is not reduced by maintaining the sufficient face height Fh on the heel side, which can afford a golfer a feeling of relief when addressing a golf ball with the head.

The first, second, third, and fourth embodiments satisfy the following relationship (f). The first, third and fourth embodiments further satisfy the following relationship (f1). Accordingly, the advantageous effects brought by the above relationship (e) are further enhanced.

$$Ft/Tt < Fc/Tc \leq Fh/Th \quad \text{(f)}$$

$$Ft/Tt < Fc/Tc < Fh/Th \quad \text{(f1)}$$

The first, second, third, and fourth embodiments do not satisfy the relationship (b) or relationship (b1). The head may satisfy the relationship (b) instead of the relationship (a). The head may satisfy the relationship (b1) instead of the relationship (a1). The head may satisfy the relationships (a) and (b). The head may satisfy the relationships (a1) and (b1). When the face height Ft is excessively small, the hitting face looks narrow, which can reduce golfer's feeling of relief when addressing a golf ball with the head. From this viewpoint, it is preferable that the relationship (b) is not satisfied when the relationship (a) is satisfied, and it is more preferable that the relationship (b2) or (b3) is satisfied when the relationship (a) is satisfied. It is preferable that the relationship (b1) is not satisfied when the relationship (a1) is satisfied, and it is more preferable that the relationship (b2) or (b3) is satisfied when the relationship (a1) is satisfied.

The fifth embodiment satisfies the relationships (b) and (b1). When a head satisfies the relationships (b) and (b1), the range of variation of the sole-side curvature radius S is wide, which tends to have an increased effect on the shape of the sole surface. The shape of the sole surface influences ground resistance of the head. From the viewpoint of degree of freedom in design of the shape of the sole surface, a head that does not satisfy the relationship (b) or (b1) is preferable. On the other hand, when the relationship (b) or (b1) is satisfied, the relationship (e) can also be attained without needing variation of the curvature radius R. A variation of the curvature radius R tends to have an influence on how the head looks (appearance of the head) from a golfer addressing a golf ball with the head. If the appearance of the head viewed by a golfer addressing a golf ball with the head is required to be the same as that of a conventional head, the head can satisfy the relationship (b) or (b1).

The fifth embodiment satisfies the relationships (b) and (b1). As to the distribution of hitting points on the face surface, the face surface has a higher density of hitting points in a region that extends from its heel lower side to toe upper side. The hitting face can be formed on such a region having a high density of hitting points by satisfying the relationship (b) or (b1).

A position spaced 15 mm apart from the face center C1 toward the toe side is also referred to as a toe reference position. The position of the face center C1 is also referred to as a center position. A position spaced 15 mm apart from the face center C1 toward the heel side is also referred to as a heel reference position. The main hitting area is a region that extends from the heel reference position to the toe reference position.

In the first embodiment, the curvature radius R continuously varies in the main hitting area. In this main hitting area, the curvature radius R increases toward the toe side. These hold true in the second, third and fourth embodiments. In the fifth embodiment, the curvature radius S continuously varies in the main hitting area. In this main hitting area, the curvature radius S increases toward the toe side.

In the first embodiment, the curvature radius R varies also in a toe-side region with respect to the main hitting area (see FIG. 3). The curvature radius R at a position spaced 5 mm apart from the toe reference position toward the toe side is represented by a curvature radius Rt1. The curvature radius Rt1 is larger than the curvature radius Rt. The curvature radius R at a position spaced 15 mm apart from the toe reference position toward the toe side is represented by a curvature radius Rt2. The curvature radius Rt2 is larger than the curvature radius Rt. The curvature radius Rt2 is larger than the curvature radius Rt1. These hold true in the second, third and fourth embodiments.

In the third embodiment (fairway wood type head) and the fourth embodiment (hybrid type head), the sole-side curvature radius S is smaller than the crown-side curvature radius R. That is, the curvature radius St is smaller than the curvature radius Rt, the curvature radius Sc is smaller than the curvature radius Rc, and the curvature radius Sh is smaller than the curvature radius Rh. Fairway wood type heads and hybrid type heads have many opportunities to hit a ball that is placed directly on turf without being teed up. When the curvature radius S is great, a distance in the vertical direction between the ground and the leading edge tends to be great. This tends to cause missed shots (so called top in Japanese, or thin shots in English) when hitting a ball placed directly on turf. The third and fourth embodiments can prevent such missed shots.

From the viewpoint of preventing the above-described missed shots, the following condition is preferable for fairway wood type heads and hybrid type heads. The curvature radius St is preferably less than or equal to 7.0 mm, more preferably less than or equal to 6.0 mm, still more preferably less than or equal to 5.0 mm, and yet more preferably less than or equal to 4.0 mm. From the viewpoint of suppressing the increase of the face height Ft, the curvature radius St is preferably greater than or equal to 1.5 mm, more preferably greater than or equal to 2.0 mm, and still more preferably greater than or equal to 2.5 mm.

From the viewpoint of preventing the above-described missed shots, the following condition is preferable for fairway wood type heads and hybrid type heads. The curvature radius Sc is preferably less than or equal to 7.0 mm, more preferably less than or equal to 6.0 mm, still more preferably less than or equal to 5.0 mm, and yet more preferably less than or equal to 4.0 mm. From the viewpoint of ground resistance, the curvature radius Sc is preferably greater than or equal to 1.5 mm, more preferably greater than or equal to 2.0 mm, and still more preferably greater than or equal to 2.5 mm.

From the viewpoints of preventing the above-described missed shots and maintaining a sufficient face height Fh, the following condition is preferable for fairway wood type heads and hybrid type heads. The curvature radius Sh is preferably less than or equal to 7.0 mm, more preferably less than or equal to 6.0 mm, still more preferably less than or equal to 5.0 mm, and yet more preferably less than or equal to 4.0 mm. From the viewpoint of ground resistance, the curvature radius Sh is preferably greater than or equal to 1.5 mm, more preferably greater than or equal to 2.0 mm, and still more preferably greater than or equal to 2.5 mm.

A driver head can have a larger curvature radius S as compared with curvature radii S of a fairway wood type head and a hybrid type head. A driver head hits a ball that is teed up, and thus is less likely to cause the above-described missed shots. A driver head has a relatively large face height F, and thus there is a large room for reducing the face height F. From these viewpoints, it is preferable to enhance the rebound performance of driver heads by having a relatively larger curvature radius S and increasing the amount of bending in the boundary portion on the sole. In driver heads, the curvature radius St, the curvature radius Sc and the curvature radius Sh can be set to be greater than or equal to 7.5 mm, further set to be greater than or equal to 8.0 mm, and still further set to be greater than or equal to 8.5 mm. From the viewpoint of preventing an excessively small face height Ft, the curvature radius St, the curvature radius Sc, and the curvature radius Sh of driver heads can be set to be less than or equal to 12.0 mm, further set to be less than or equal to 11.0 mm, and still further set to be less than or equal to 10.0 mm.

From the viewpoint of preventing the above-described missed shots, Rt/St is preferably greater than or equal to 1.5, more preferably greater than or equal to 2.0, and still more preferably greater than or equal to 2.5. Considering preferable values of the curvature radius St and the face height Ft, Rt/St is preferably less than or equal to 5.0, more preferably less than or equal to 4.5, and still more preferably less than or equal to 4.0.

From the viewpoint of preventing the above-described missed shots, Rc/Sc is preferably greater than or equal to 1.5, more preferably greater than or equal to 2.0, and still more preferably greater than or equal to 2.5. Considering preferable values of the curvature radius Sc and the face height Fc, Rc/Sc is preferably less than or equal to 5.0, more preferably less than or equal to 4.5, and still more preferably less than or equal to 4.0.

From the viewpoint of preventing the above-described missed shots, Rh/Sh is preferably greater than or equal to 1.0, more preferably greater than or equal to 1.5, and still more preferably greater than or equal to 2.0. Considering preferable values of the curvature radius Sh and the face height Fh, Rh/Sh is preferably less than or equal to 4.5, more preferably less than or equal to 4.0, and still more preferably less than or equal to 3.5.

Rt/Rh is a ratio of the curvature radius Rt on the toe side to the curvature radius Rh on the heel side. From the viewpoints of the toe durability improvement effect, the toe rebound performance maintaining effect, and the heel rebound performance improvement effect, Rt/Rh is preferably greater than or equal to 1.20, more preferably greater than or equal to 1.25, still more preferably greater than or equal to 1.30, still more preferably greater than or equal to 1.35, and yet more preferably greater than or equal to 1.40. An excessively large curvature radius Rt can lead to an excessively small face height Ft, which can worsen golfer's feeling of relief when addressing a golf ball with the head. From this viewpoint, Rt/Rh is preferably less than or equal to 1.80, more preferably less than or equal to 1.75, and still more preferably less than or equal to 1.70.

When the relationship (a) or (a1) is satisfied and Rt/Rh is great, St/Sh is preferably small. When both Rt/Rh and St/Sh are great, the face height Ft can be excessively small. An excessively small face height Ft can lead to deterioration of golfer's feeling of relief when addressing a golf ball with the head. From this viewpoint, when Rt/Rh falls within the above-described preferable range of greater than or equal to 1.20, St/Sh is preferably less than or equal to 1.15, more preferably less than or equal to 1.10, and still more preferably less than or equal to 1.05. An excessively small curvature radius St can increase the face height Ft, which can lead to deterioration of the toe durability improvement effect. From this viewpoint, St/Sh is preferably greater than or equal to 0.80, more preferably greater than or equal to 0.85, and still more preferably greater than or equal to 0.90.

Ft/Fh is a ratio of the face height Ft on the toe side to the face height Fh on the heel side. From the viewpoints of the toe durability improvement effect, the toe rebound performance maintaining effect, and the heel rebound performance improvement effect, Ft/Fh is preferably less than or equal to 1.15, more preferably less than or equal to 1.12, still more preferably less than or equal to 1.09, and yet more preferably less than or equal to 1.06. An excessively large curvature radius Rt or an excessively large curvature radius St can cause an excessively small face height Ft, which can lead to deterioration of golfer's feeling of relief when addressing a golf ball with the head. From this viewpoint, Ft/Fh is preferably greater than or equal to 0.85, more preferably greater than or equal to 0.90, and still more preferably greater than or equal to 0.95.

As shown in FIG. 3, the curvature radius R at a position spaced 5 mm apart from the toe reference position toward the toe side is represented by the curvature radius Rt1. The curvature radius Rt1 is larger than the curvature radius Rt. The face height F at the same position is represented by a face height Ft1. The face height Ft1 is smaller than the face height Ft.

As shown in FIG. 3, the face height F at a position spaced 15 mm apart from the toe reference position toward the toe side is represented by a face height Ft2. The face height Ft2 is smaller than the face height Ft. The curvature radius R at the same position is represented by the curvature radius Rt2. The curvature radius S at the same position is represented by a curvature radius St2. As described above, the curvature radius Rt2 is larger than the curvature radius Rt. Such a large curvature radius Rt2 makes the face height Ft2 small.

From the viewpoint of enlarging an area exhibiting the above-described advantageous effects toward the toe side with respect to the main hitting area, Ft2/Fh is preferably less than or equal to 0.97, more preferably less than or equal to 0.94, and still more preferably less than or equal to 0.91. An excessively large curvature radius Rt2 or an excessively large curvature radius St2 can cause an excessively small face height Ft2, which can lead to deterioration of golfer's feeling of relief when addressing a golf ball with the head. From this viewpoint, Ft2/Fh is preferably greater than or equal to 0.55, more preferably greater than or equal to 0.60, and still more preferably greater than or equal to 0.65.

From the viewpoint of: satisfying the relationship (a) or (a1), and the relationship (e); enhancing the advantageous effects brought by these relationships; and conforming to specifications of respective head types, the curvature radius R can be set to be the following ranges. In the following descriptions, (x) shows a preferable range, (y) shows a more preferable range, and (z) shows a still more preferable range.

[Curvature Radius Rt of a Driver Head]
- (x) greater than or equal to 9.5 mm and less than or equal to 13.5 mm
- (y) greater than or equal to 10.0 mm and less than or equal to 13.0 mm
- (z) greater than or equal to 10.5 mm and less than or equal to 12.5 mm

[Curvature Radius Rc of a Driver Head]
- (x) greater than or equal to 7.5 mm and less than or equal to 11.5 mm
- (y) greater than or equal to 8.0 mm and less than or equal to 11.0 mm
- (z) greater than or equal to 8.5 mm and less than or equal to 10.5 mm

[Curvature Radius Rh of a Driver Head]
- (x) greater than or equal to 6.0 mm and less than or equal to 10.0 mm
- (y) greater than or equal to 6.5 mm and less than or equal to 9.5 mm
- (z) greater than or equal to 7.0 mm and less than or equal to 9.0 mm

[Curvature Radius Rt of a Fairway Wood Type Head]
- (x) greater than or equal to 10.0 mm and less than or equal to 14.0 mm
- (y) greater than or equal to 10.5 mm and less than or equal to 13.5 mm
- (z) greater than or equal to 11.0 mm and less than or equal to 13.0 mm

[Curvature Radius Rc of a Fairway Wood Type Head]
- (x) greater than or equal to 8.0 mm and less than or equal to 12.0 mm
- (y) greater than or equal to 8.5 mm and less than or equal to 11.5 mm
- (z) greater than or equal to 9.0 mm and less than or equal to 11.0 mm

[Curvature Radius Rh of a Fairway Wood Type Head]
- (x) greater than or equal to 6.0 mm and less than or equal to 10.0 mm
- (y) greater than or equal to 6.5 mm and less than or equal to 9.5 mm
- (z) greater than or equal to 7.0 mm and less than or equal to 9.0 mm

[Curvature Radius Rt of a Hybrid Type Head]

(x) greater than or equal to 7.5 mm and less than or equal to 11.5 mm (y) greater than or equal to 8.0 mm and less than or equal to 11.0 mm (z) greater than or equal to 8.5 mm and less than or equal to 10.5 mm

[Curvature Radius Rc of a Hybrid Type Head]

(x) greater than or equal to 6.0 mm and less than or equal to 10.0 mm (y) greater than or equal to 6.5 mm and less than or equal to 9.5 mm (z) greater than or equal to 7.0 mm and less than or equal to 9.0 mm

[Curvature Radius Rh of a Hybrid Type Head]

(x) greater than or equal to 4.5 mm and less than or equal to 8.5 mm (y) greater than or equal to 5.0 mm and less than or equal to 8.0 mm (z) greater than or equal to 5.5 mm and less than or equal to 7.5 mm From the viewpoint of: satisfying the relationship (e), (f), or (f1); enhancing the advantageous effects brought by these relationships; and conforming to specifications of respective head types, the ratio (F/T) can be set to be the following ranges. In the following descriptions, (x) shows a preferable range, (y) shows a more preferable range, and (z) shows a still more preferable range.

[Ft/Tt of a Driver Head]

(x) greater than or equal to 0.61 and less than or equal to 0.71

(y) greater than or equal to 0.62 and less than or equal to 0.70

(z) greater than or equal to 0.63 and less than or equal to 0.69

[Fc/Tc of a Driver Head]

(x) greater than or equal to 0.62 and less than or equal to 0.72

(y) greater than or equal to 0.63 and less than or equal to 0.71

(z) greater than or equal to 0.64 and less than or equal to 0.70

[Fh/Th of a Driver Head]

(x) greater than or equal to 0.64 and less than or equal to 0.74

(y) greater than or equal to 0.65 and less than or equal to 0.73

(z) greater than or equal to 0.66 and less than or equal to 0.72

[Ft/Tt of a Fairway Wood Type Head]

(x) greater than or equal to 0.58 and less than or equal to 0.68

(y) greater than or equal to 0.59 and less than or equal to 0.67

(z) greater than or equal to 0.60 and less than or equal to 0.66

[Fc/Tc of a Fairway Wood Type Head]

(x) greater than or equal to 0.62 and less than or equal to 0.72

(y) greater than or equal to 0.63 and less than or equal to 0.71

(z) greater than or equal to 0.64 and less than or equal to 0.70

[Fh/Th of a Fairway Wood Type Head]

(x) greater than or equal to 0.63 and less than or equal to 0.73

(y) greater than or equal to 0.64 and less than or equal to 0.72

(z) greater than or equal to 0.65 and less than or equal to 0.71

[Ft/Tt of a Hybrid Type Head]

(x) greater than or equal to 0.68 and less than or equal to 0.78

(y) greater than or equal to 0.69 and less than or equal to 0.77

(z) greater than or equal to 0.70 and less than or equal to 0.76

[Fc/Tc of a Hybrid Type Head]

(x) greater than or equal to 0.71 and less than or equal to 0.81

(y) greater than or equal to 0.72 and less than or equal to 0.80

(z) greater than or equal to 0.73 and less than or equal to 0.79

[Fh/Th of a Hybrid Type Head]

(x) greater than or equal to 0.72 and less than or equal to 0.82

(y) greater than or equal to 0.73 and less than or equal to 0.81

(z) greater than or equal to 0.74 and less than or equal to 0.80

Examples of general specifications of a driver head (including a mini driver head treated equally with a driver head) include the following (1a) to (1e):

(1a) curved hitting face;

(1b) hollow structure;

(1c) head volume of greater than or equal to 300 $cm^3$ and less than or equal to 470 $cm^3$;

(1d) real loft angle of greater than or equal to 7 degrees and less than or equal to 13 degrees; and (1e) presence of a crown.

Examples of club numbers of fairway wood type heads include a number 3 wood (W #3), a number 4 wood (W #4), a number 5 wood (W #5), a number 7 wood (W #7), a number 9 wood (W #9), a number 11 wood (W #11), and a number 13 wood (W #13). Examples of specifications of a normal fairway wood type head include the following (2a) to (2e):

(2a) curved hitting face;

(2b) hollow structure;

(2c) head volume of greater than or equal to 100 cm, and less than or equal to 300 $cm^3$;

(2d) real loft angle of greater than 13 degrees and less than or equal to 33 degrees; and (2e) presence of a crown.

Examples of club numbers of hybrid type heads include a number 3 hybrid (H3), a number 4 hybrid (H4), a number 5 hybrid (H5), and a number 6 hybrid (H6). Examples of structures of a normal hybrid type head include the following (3a) to (3e):

(3a) curved hitting face;

(3b) hollow structure;

(3c) head volume of greater than or equal to 90 $cm^3$ and less than or equal to 140 $cm^3$;

(3d) real loft angle of greater than or equal to 15 degrees and less than or equal to 33 degrees; and (3e) presence of a crown.

Hybrid type heads are also referred to as utility type heads in Japan. Hybrid type heads may be classified as wood type or iron type. A hybrid type head classified as iron type does not include a crown.

A head that has a crown, has a loft angle (real loft angle) of greater than 13 degrees, and has a head volume of less than 300 $cm^3$ can be classified as a fairway wood type head or a hybrid type head. W1/W2 can be used to distinguish between a fairway wood type head and a hybrid type head. A double-pointed arrow W1 in FIG. 13 shows a width of the head in the face-back direction. A double-pointed arrow W2 in FIG. 13 shows a width of the head in the toe-heel direction. W1/W2 of a hybrid type head is less than 0.65. W1/W2 of a fairway wood type head is greater than or equal to 0.65. A head that has a crown and has a head volume of greater than or equal to 300 $cm^3$ can be classified as a driver head.

Figure 17A:
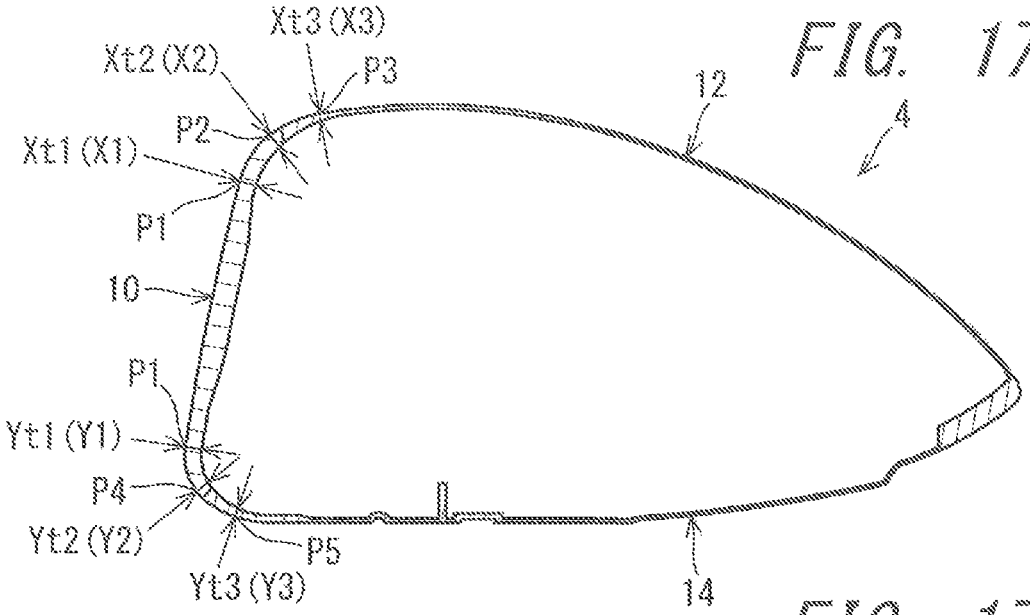
FIG. 17A is a cross-sectional view taken along line a-a in FIG. 3.
Figure 17B:
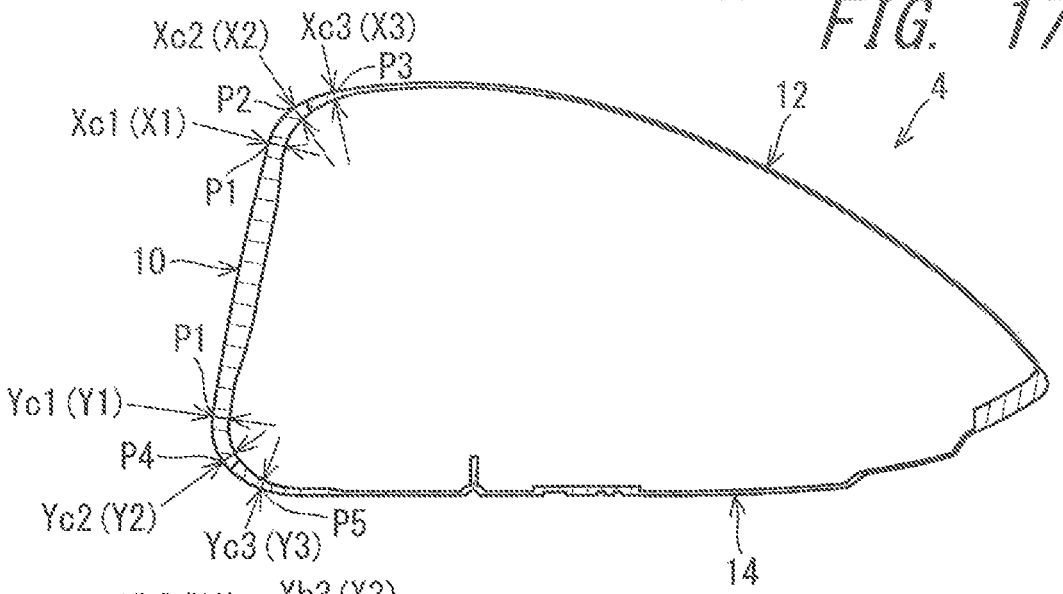
FIG. 17B is a cross-sectional view taken along line b-b in FIG. 3.
Figure 17C:
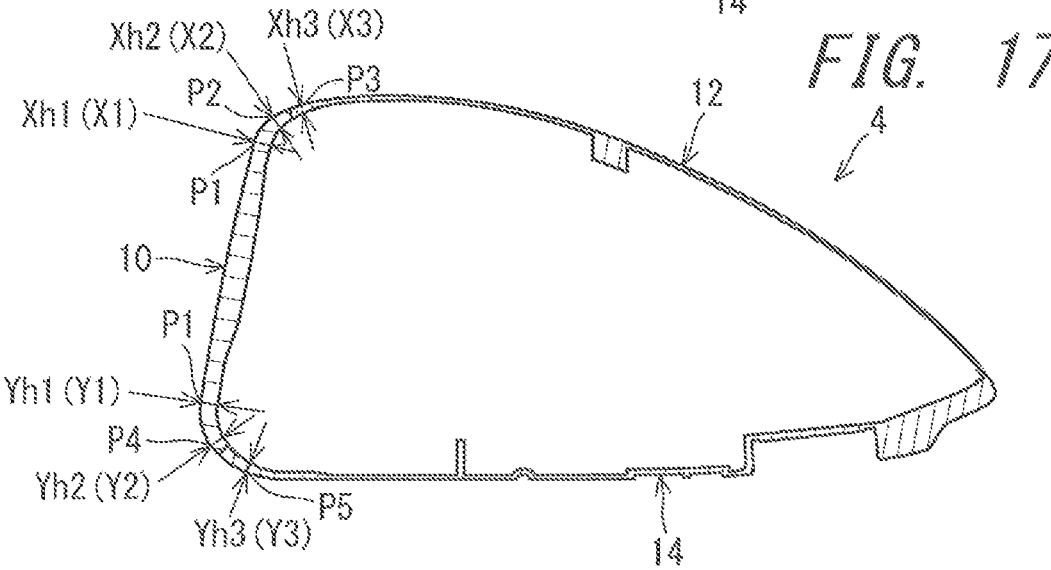
FIG. 17C is a cross-sectional view taken along line c-c in FIG. 3.

FIG. 17A is a cross-sectional view taken along line a-a in FIG. 3. FIG. 17B is a cross-sectional view taken along line b-b in FIG. 3. FIG. 17C is a cross-sectional view taken along line c-c in FIG. 3. Unlike FIG. 5A to FIG. 5C, FIG. 17A to FIG. 17C are fully-drawn cross-sectional views including cross sections of the head wall. FIG. 17A is a cross-sectional view at the toe reference position. FIG. 17B is a cross-sectional view at the center position. FIG. 17C is a cross-sectional view at the heel reference position.

As explained with reference to FIG. 6, in each vertical cross section, the outer surface of the head 4 includes the point P1, the point P2 and the point P3 on the crown side, and the point P1, the point P4 and the point P5 on the sole side.

On the crown side of the head 4, a head wall thickness (hereinafter simply referred to as wall thickness) at the point P1 is denoted by X1 (mm), a wall thickness at the point P2 is denoted by X2 (mm), and a wall thickness at the point P3 is denoted by X3 (mm). On the sole side of the head 4, a wall thickness at the point P1 is denoted by Y1 (mm), a wall thickness at the point P4 is denoted by Y2 (mm), and a wall thickness at the point P5 is denoted by Y3 (mm). The wall thickness means a thickness between the outer surface and the inner surface of the head 4. The wall thickness is measured in a vertical cross section and measured along a line normal to the outer surface of the head 4.

As shown in FIG. 17A, X1 at the toe reference position is denoted by Xt1, X2 at the toe reference position is denoted by Xt2, and X3 at the toe reference position is denoted by Xt3. Y1 at the toe reference position is denoted by Yt1, Y2 at the toe reference position is denoted by Yt2, and Y3 at the toe reference position is denoted by Yt3.

As shown in FIG. 17B, X1 at the center position is denoted by Xc1, X2 at the center position is denoted by Xc2, and X3 at the center position is denoted by Xc3. Y1 at the center position is denoted by Yc1, Y2 at the center position is denoted by Yc2, and Y3 at the center position is denoted by Yc3.

As shown in FIG. 17C, X1 at the heel reference position is denoted by Xh1, X2 at the heel reference position is denoted by Xh2, and X3 at the heel reference position is denoted by Xh3. Y1 at the heel reference position is denoted by Yh1, Y2 at the heel reference position is denoted by Yh2, and Y3 at the heel reference position is denoted by Yh3.

The wall thickness Xt3 is smaller than the wall thickness Xc3. The wall thickness Xc3 is smaller than the wall thickness Xh3. The following relationship (g) is established on the crown side.

$$Xt3 < Xc3 < Xh3 \quad \text{(g)}$$

In the main hitting area, the wall thickness X3 continuously varies in the toe-heel direction. The wall thickness X3 decreases toward the toe side in the main hitting area.

As shown in FIG. 17A, the wall thickness Xt1 is larger than the wall thickness Xt2. The wall thickness Xt1 is larger than the wall thickness Xt3. The wall thickness Xt2 is larger than the wall thickness Xt3. The wall thickness Yt1 is larger than the wall thickness Yt2. The wall thickness Yt1 is larger than the wall thickness Yt3. The wall thickness Yt2 is larger than the wall thickness Yt3.

As shown in FIG. 17B, the wall thickness Xc1 is larger than the wall thickness Xc2. The wall thickness Xc1 is larger than the wall thickness Xc3. The wall thickness Xc2 is larger than the wall thickness Xc3. The wall thickness Yc1 is larger than the wall thickness Yc2. The wall thickness Yc1 is larger than the wall thickness Yc3. The wall thickness Yc2 is larger than the wall thickness Yc3.

As shown in FIG. 17C, the wall thickness Xh1 is larger than the wall thickness Xh2. The wall thickness Xh1 is larger than the wall thickness Xh3. The wall thickness Xh2 is larger than the wall thickness Xh3. The wall thickness Yh1 is larger than the wall thickness Yh2. The wall thickness Yh1 is larger than the wall thickness Yh3. The wall thickness Yh2 is larger than the wall thickness Yh3.

As described above, the following relationships (i1) and (i2) are satisfied regarding wall thicknesses at the toe reference position, at the center position, and at the heel reference position on the crown side of the head.

$$X1 > X3 \quad \text{(i1)}$$

$$X1 > X2 > X3 \quad \text{(i2)}$$

The following relationships (j1) and (j2) are satisfied regarding wall thicknesses at the toe reference position, at the center position, and at the heel reference position on the sole side of the head.

$$Y1 > Y3 \quad \text{(j1)}$$

$$Y1 \geq Y2 > Y3 \quad \text{(j2)}$$

From the viewpoints of the toe durability improvement effect and the toe rebound performance maintaining effect, when the relationship (a) or (a1) is satisfied as in the first to fourth embodiments, the above-described relationship (g) as shown below is preferably satisfied.

$$Xt3 < Xc3 < Xh3 \quad \text{(g)}$$

From the viewpoints of the toe durability improvement effect and the toe rebound performance maintaining effect, when the relationship (b) or (b1) is satisfied as in the fifth embodiment, the wall thickness Yt3 is preferably smaller than the wall thickness Yc3, the wall thickness Yc3 is preferably smaller than the wall thickness Yh3, and it is more preferable that the following relationship (h) is satisfied. In this case, the wall thickness Y3 in the main hitting area preferably varies continuously in the toe-heel direction.

$$Yt3 < Yc3 < Yh3 \quad \text{(h)}$$

From the viewpoints of the toe durability improvement effect and the toe rebound performance maintaining effect, the wall thickness Xt3 is preferably less than or equal to 1.2 mm, more preferably less than or equal to 1.1 mm, and still more preferably less than or equal to 1.0 mm. From the viewpoint of durability of the head, the wall thickness Xt3 is preferably greater than or equal to 0.4 mm, more preferably greater than or equal to 0.5 mm, and still more preferably greater than or equal to 0.6 mm.

From the viewpoint of rebound performance, the wall thickness Xc3 is preferably less than or equal to 1.2 mm, more preferably less than or equal to 1.1 mm, and still more preferably less than or equal to 1.0 mm. From the viewpoint of durability of the head, the wall thickness Xc3 is preferably greater than or equal to 0.4 mm, more preferably greater than or equal to 0.5 mm, and still more preferably greater than or equal to 0.6 mm.

From the viewpoint of rebound performance, the wall thickness Xh3 is preferably less than or equal to 1.2 mm, more preferably less than or equal to 1.1 mm, and still more preferably less than or equal to 1.0 mm. From the viewpoint of durability of the head, the wall thickness Xh3 is preferably greater than or equal to 0.4 mm, more preferably greater than or equal to 0.5 mm, and still more preferably greater than or equal to 0.6 mm.

From the viewpoints of the toe durability improvement effect and the toe rebound performance maintaining effect, the wall thickness Yt3 is preferably less than or equal to 1.3 mm, more preferably less than or equal to 1.2 mm, and still more preferably less than or equal to 1.1 mm. From the viewpoint of durability of the head, the wall thickness Yt3 is preferably greater than or equal to 0.5 mm, more preferably greater than or equal to 0.6 mm, and still more preferably greater than or equal to 0.7 mm.

From the viewpoint of rebound performance, the wall thickness Yc3 is preferably less than or equal to 1.3 mm, more preferably less than or equal to 1.2 mm, and still more preferably less than or equal to 1.1 mm. From the viewpoint of durability of the head, the wall thickness Yc3 is preferably greater than or equal to 0.5 mm, more preferably greater than or equal to 0.6 mm, and still more preferably greater than or equal to 0.7 mm.

From the viewpoint of rebound performance, the wall thickness Yh3 is preferably less than or equal to 1.3 mm, more preferably less than or equal to 1.2 mm, and still more preferably less than or equal to 1.1 mm. From the viewpoint of durability of the head, the wall thickness Yh3 is preferably greater than or equal to 0.5 mm, more preferably greater than or equal to 0.6 mm, and still more preferably greater than or equal to 0.7 mm.

When the wall thickness in the boundary portion between the hitting face and the crown surface becomes thinner toward the back side, strength is increased toward the face side and stress is dispersed, which can bend the boundary portion. From the viewpoints of durability and rebound performance of the head, the first to fifth embodiments (heads 4, 24, 44, 64 and 84) preferably satisfy the following relationship (i1), and more preferably satisfy the following relationship (i2) in at least one cross section taken in the main hitting area.

$$X1 > X3 \quad \text{(i1)}$$

$$X1 > X2 > X3 \quad \text{(i2)}$$

When the wall thickness in the boundary portion between the hitting face and the sole surface becomes thinner toward the back side, strength is increased toward the face side, stress is dispersed, and the boundary portion can be bent. From the viewpoints of durability and rebound performance of the head, the first to fifth embodiments (heads 4, 24, 44, 64 and 84) preferably satisfy the following relationship (j1), and more preferably satisfy the following relationship (j2) in at least one cross section taken in the main hitting area.

$$Y1 > Y3 \quad \text{(j1)}$$

$$Y1 \geq Y2 > Y3 \quad \text{(j2)}$$

Regarding the above-described embodiments, the following clauses are disclosed. The following clauses are claims originally recited in a corresponding patent application filed in Japan.

[Clause 1]

A golf club head including:

a hitting face that includes a face center;

a crown surface; and a sole surface, wherein a boundary portion between the hitting face and the crown surface has a curvature radius denoted by R, a boundary portion between the hitting face and the sole surface has a curvature radius denoted by S, the hitting face has a face height denoted by F, the golf club head has a head thickness denoted by T, the curvature radius R at a position spaced 15 mm apart from the face center toward a toe side is referred to as a curvature radius Rt, the curvature radius S at the same position is referred to as a curvature radius St, the face height F at the same position is referred to as a face height Ft, and the head thickness T at the same position is referred to as a head thickness Tt, the curvature radius R at a position of the face center is referred to as a curvature radius Rc, the curvature radius S at the same position is referred to as a curvature radius Sc, the face height F at the same position is referred to as a face height Fc, and the head thickness T at the same position is referred to as a head thickness Tc, the curvature radius R at a position spaced 15 mm apart from the face center toward a heel side is referred to as a curvature radius Rh, the curvature radius S at the same position is referred to as a curvature radius Sh, the face height F at the same position is referred to as a face height Fh, and the head thickness T at the same position is referred to as a head thickness Th, Ft/Tt is smaller than Fh/Th, and the golf club head satisfies the following relationship (a) and/or the following relationship (b):

$$Rt > Rc \geq Rh; \quad \text{(a)}$$

$$St > Sc \geq Sh. \quad \text{(b)}$$

[Clause 2]

The golf club head according to clause 1, satisfying the relationship (a) shown below:

$$Rt > Rc \geq Rh. \quad \text{(a)}$$

[Clause 3]

The golf club head according to clause 2, wherein Rt/Rh is greater than or equal to 1.2.

[Clause 4]

The golf club head according to any one of clauses 1 to 3, wherein the golf club head is a driver head, the curvature radius Rt is greater than or equal to 9.5 mm and less than or equal to 13.5 mm, the curvature radius Rc is greater than or equal to 7.5 mm and less than or equal to 11.5 mm, and the curvature radius Rh is greater than or equal to 6.0 mm and less than or equal to 10.0 mm.

[Clause 5]

The golf club head according to any one of clauses 1 to 3, wherein the golf club head has a loft angle of greater than 13°, the golf club head has a head volume of less than 300 $cm^3$, the curvature radius St is smaller than the curvature radius Rt, the curvature radius Sc is smaller than the curvature radius Rc, and the curvature radius Sh is smaller than the curvature radius Rh.

[Clause 6]

The golf club head according to clause 5, wherein the golf club head is a fairway wood type head, the curvature radius Rt is greater than or equal to 10.0 mm and less than or equal to 14.0 mm, the curvature radius Rc is greater than or equal to 8.0 mm and less than or equal to 12.0 mm, and the curvature radius Rh is greater than or equal to 6.0 mm and less than or equal to 10.0 mm.

[Clause 7]

The golf club head according to clause 5, wherein the golf club head is a hybrid type head, the curvature radius Rt is greater than or equal to 7.5 mm and less than or equal to 11.5 mm, the curvature radius Rc is greater than or equal to 6.0 mm and less than or equal to 10.0 mm, and the curvature radius Rh is greater than or equal to 4.5 mm and less than or equal to 8.5 mm.

LIST OF REFERENCE SYMBOLS

2 Golf club
4, 24, 44, 64, 84 Head
6 Shaft
8 Grip
10, 30, 50, 70, 90 Face portion
10*a*, 30*a*, 50*a*, 70*a*, 90*a* Hitting face
12, 32, 52, 72, 92 Crown portion
12*a*, 32*a*, 52*a*, 72*a*, 92*a* Crown surface
14, 34, 54, 74, 94 Sole portion
14*a*, 34*a*, 54*a*, 74*a*, 94*a* Sole surface
16, 36, 56, 76, 96 Hosel portion
k1 Outer edge of the hitting face
F Face height
Ft Face height at the toe reference position
Fc Face height at the center position
Fh Face height at the heel reference position
T Head thickness
Tt Head thickness at the toe reference position
Tc Head thickness at the center position
Th Head thickness at the heel reference position
R Curvature radius of the boundary portion between the hitting face and the crown surface
Rt Curvature radius, at the toe reference position, of the boundary portion between the hitting face and the crown surface
Rc Curvature radius, at the center position, of the boundary portion between the hitting face and the crown surface
Rh Curvature radius, at the heel reference position, of the boundary portion between the hitting face and the crown surface
S Curvature radius of the boundary portion between the hitting face and the sole surface
St Curvature radius, at the toe reference position, of the boundary portion between the hitting face and the sole surface
Sc Curvature radius, at the center position, of the boundary portion between the hitting face and the sole surface
Sh Curvature radius, at the heel reference position, of the boundary portion between the hitting face and the sole surface
Z Shaft axis line The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a hitting face that includes a face center;

a crown surface; and a sole surface, wherein a boundary portion between the hitting face and the crown surface has a curvature radius denoted by R, a boundary portion between the hitting face and the sole surface has a curvature radius denoted by S, the hitting face has a face height denoted by F, the golf club head has a head thickness denoted by T, the curvature radius R at a position spaced 15 mm apart from the face center toward a toe side is referred to as a curvature radius Rt, the curvature radius S at the same position is referred to as a curvature radius St, the face height F at the same position is referred to as a face height Ft, and the head thickness T at the same position is referred to as a head thickness Tt, the curvature radius R at a position of the face center is referred to as a curvature radius Rc, the curvature radius S at the same position is referred to as a curvature radius Sc, the face height F at the same position is referred to as a face height Fc, and the head thickness T at the same position is referred to as a head thickness Tc, the curvature radius R at a position spaced 15 mm apart from the face center toward a heel side is referred to as a curvature radius Rh, the curvature radius S at the same position is referred to as a curvature radius Sh, the face height F at the same position is referred to as a face height Fh, and the head thickness T at the same position is referred to as a head thickness Th, Ft/Tt is smaller than Fh/Th, and the golf club head satisfies the following relationship (a) and/or the following relationship (b):

$$Rt > Rc \geq Rh; \quad (a)$$

$$St > Sc \geq Sh. \quad (b)$$

2. The golf club head according to claim 1, satisfying the relationship (a) shown below:

$$Rt > Rc \geq Rh. \quad (a)$$

3. The golf club head according to claim 2, wherein Rt/Rh is greater than or equal to 1.2.

4. The golf club head according to claim 1, wherein the golf club head is a driver head, the curvature radius Rt is greater than or equal to 9.5 mm and less than or equal to 13.5 mm, the curvature radius Rc is greater than or equal to 7.5 mm and less than or equal to 11.5 mm, and the curvature radius Rh is greater than or equal to 6.0 mm and less than or equal to 10.0 mm.

5. The golf club head according to claim 1, wherein the golf club head has a loft angle of greater than 13°, the golf club head has a head volume of less than 300 $cm^3$, the curvature radius St is smaller than the curvature radius Rt, the curvature radius Sc is smaller than the curvature radius Rc, and the curvature radius Sh is smaller than the curvature radius Rh.

6. The golf club head according to claim 5, wherein the golf club head is a fairway wood type head, the curvature radius Rt is greater than or equal to 10.0 mm and less than or equal to 14.0 mm, the curvature radius Rc is greater than or equal to 8.0 mm and less than or equal to 12.0 mm, and the curvature radius Rh is greater than or equal to 6.0 mm and less than or equal to 10.0 mm.

7. The golf club head according to claim 5, wherein the golf club head is a hybrid type head, the curvature radius Rt is greater than or equal to 7.5 mm and less than or equal to 11.5 mm, the curvature radius Rc is greater than or equal to 6.0 mm and less than or equal to 10.0 mm, and the curvature radius Rh is greater than or equal to 4.5 mm and less than or equal to 8.5 mm.

8. A golf club head comprising:

a hitting face that includes a face center;

a crown surface; and a sole surface, wherein a boundary portion between the hitting face and the crown surface has a curvature radius denoted by R, a boundary portion between the hitting face and the sole surface has a curvature radius denoted by S, the hitting face has a face height denoted by F, the golf club head has a head thickness denoted by T, the curvature radius R at a position spaced 15 mm apart from the face center toward a toe side is referred to as a curvature radius Rt, the curvature radius S at the same position is referred to as a curvature radius St, the face height F at the same position is referred to as a face height Ft, and the head thickness T at the same position is referred to as a head thickness Tt, the curvature radius R at a position of the face center is referred to as a curvature radius Rc, the curvature radius S at the same position is referred to as a curvature radius Sc, the face height F at the same position is referred to as a face height Fc, and the head thickness T at the same position is referred to as a head thickness Tc, the curvature radius R at a position spaced 15 mm apart from the face center toward a heel side is referred to as a curvature radius Rh, the curvature radius S at the same position is referred to as a curvature radius Sh, the face height F at the same position is referred to as a face height Fh, and the head thickness T at the same position is referred to as a head thickness Th, Ft/Tt is smaller than Fh/Th, the golf club head satisfies the following relationship (a) shown below:

$$Rt > Rc \geq Rh, \quad (a)$$

the curvature radius Rt is greater than or equal to 9.5 mm and less than or equal to 13.5 mm, the curvature radius Rc is greater than or equal to 7.5 mm and less than or equal to 11.5 mm, the curvature radius Rh is greater than or equal to 6.0 mm and less than or equal to 10.0 mm, the golf club head has a head volume of greater than or equal to 300 $cm^3$, and the golf club head has a loft angle of less than or equal to 13°.

9. The golf club head according to claim 8, wherein

Ft/Tt is greater than or equal to 0.61 and less than or equal to 0.71.

10. The golf club head according to claim 8, wherein

Fh/Th is greater than or equal to 0.64 and less than or equal to 0.74.

11. The golf club head according to claim 8, wherein

Rt/Rh is greater than or equal to 1.2.

12. The golf club head according to claim 8, wherein in a vertical cross section of the golf club head, a point P1 that constitutes an outer edge of the hitting face, a point P2 that has a minimum curvature radius in a portion that extends from the point P1 to the crown surface, and a point P3 that is disposed on a crown side of the point P2 and is positioned so that the point P2 becomes a midpoint between the point P3 and the point P1 are determined, a wall thickness at the point P3 is referred to as a wall thickness X3, the wall thickness X3 at the position spaced 15 mm apart from the face center toward the toe side is referred to as a wall thickness Xt3, the wall thickness X3 at the position of the face center is referred to as a wall thickness Xc3, the wall thickness X3 at the position spaced 15 mm apart from the face center toward the heel side is referred to as a wall thickness Xh3, and the golf club head satisfies the following relationship (g) shown below:

$$Xt3 < Xc3 < Xh3. \quad (g)$$

* * * * *